US011827318B2

(12) United States Patent
Christensen et al.

(10) Patent No.: US 11,827,318 B2
(45) Date of Patent: Nov. 28, 2023

(54) HIGH-OUTPUT MULTIFUNCTION SUBMERSIBLE MARINE LIGHTING APPARATUS

(71) Applicant: LIQUID LUMENS, LLC, Salt Lake City, UT (US)

(72) Inventors: K. Ryan Christensen, North Salt Lake, UT (US); Eric Nofsinger, North Salt Lake, UT (US); Robert D. Christensen, Salt Lake City, UT (US)

(73) Assignee: Liquid Lumens, LLC, Salt Lake City, UT (US)

( * ) Notice: Subject to any disclaimer, the term of this patent is extended or adjusted under 35 U.S.C. 154(b) by 91 days.

(21) Appl. No.: 16/786,926

(22) Filed: Feb. 10, 2020

(65) Prior Publication Data

US 2020/0172212 A1 Jun. 4, 2020

Related U.S. Application Data

(63) Continuation-in-part of application No. 16/109,480, filed on Aug. 22, 2018, now abandoned, which is a (Continued)

(51) Int. Cl.
*F21V 31/00* (2006.01)
*B63B 45/02* (2006.01)

(Continued)

(52) U.S. Cl.
CPC ..... *B63B 45/02* (2013.01); *F21V 5/045* (2013.01); *F21V 5/048* (2013.01); *F21V 17/12* (2013.01);

(Continued)

(58) Field of Classification Search
CPC . F21Y 2115/10; F21Y 2105/10; F21V 31/005
See application file for complete search history.

(56) References Cited

U.S. PATENT DOCUMENTS 4,574,337 A 3/1986 Poppenheimer
4,979,281 A * 12/1990 Smith ..... F16B 35/00 403/18

(Continued)

OTHER PUBLICATIONS

None, "List of thermal conductivies", Retrieved Jul. 2022, www.wikpedia.org/wiki/List_of_thermal_conductivities (Year: 2022).*

(Continued)

*Primary Examiner* — Christopher Stanford
(74) *Attorney, Agent, or Firm* — Workman Nydegger

(57) ABSTRACT

A submersible marine lighting apparatus is provided that includes voltage up-conversion and that is configured to intensify emitted light by reducing a transmission angle of the light through one or more techniques including increasing the distance between the light emitter and an optical lens. The submersible marine lighting apparatus includes a circular base, an LED array positioned in a recess in the base, an optical lens, a lens gasket, and a retaining ring. The lens gasket cooperating with the circular base, optical lens and retaining ring to form a waterproof seal between the circular base and the retaining ring. When attached to a watercraft, the interior of the lighting apparatus is sealed from water.

20 Claims, 26 Drawing Sheets

Related U.S. Application Data continuation-in-part of application No. 15/206,190, filed on Jul. 8, 2016, now abandoned.

(51) Int. Cl.

| | |
|---|---|
| ***F21V 29/89*** | (2015.01) |
| ***F21V 5/04*** | (2006.01) |
| ***F21V 17/12*** | (2006.01) |
| ***F21V 23/04*** | (2006.01) |
| *F21Y 115/10* | (2016.01) |

(52) U.S. Cl.

CPC ..... *F21V 23/0435* (2013.01); *F21V 29/89* (2015.01); *F21V 31/005* (2013.01); *F21Y 2115/10* (2016.08)

(56) References Cited

U.S. PATENT DOCUMENTS

| | | | | |
|---|---|---|---|---|
| 7,396,139 | B2 * | 7/2008 | Savage | F21V 5/04 362/267 |
| 7,431,477 | B2 | 10/2008 | Chou et al. | |
| 7,824,076 | B2 | 11/2010 | Koester | |
| 8,167,468 | B1 * | 5/2012 | Olsson | F21V 33/00 362/267 |
| 8,651,704 | B1 | 2/2014 | Gordin | |
| 8,675,332 | B1 | 3/2014 | Green et al. | |
| 8,831,723 | B2 | 10/2014 | Peck et al. | |
| 9,285,109 | B1 | 3/2016 | Olsson et al. | |
| 9,797,590 | B2 * | 10/2017 | Zhang | F21S 8/085 |
| 2007/0201238 | A1 | 8/2007 | Hurley | |
| 2007/0230194 | A1 | 10/2007 | Julia Vilarrasa | |
| 2010/0002435 | A1 | 1/2010 | Rash | |
| 2010/0128473 | A1 | 5/2010 | Parra | |
| 2011/0188244 | A1 * | 8/2011 | Hong | F21V 5/00 362/296.01 |
| 2011/0304269 | A1 | 12/2011 | Wang | |
| 2013/0094210 | A1 | 4/2013 | Rice | |
| 2013/0207137 | A1 | 8/2013 | Lee | |
| 2013/0223064 | A1 | 8/2013 | Lee | |
| 2014/0043817 | A1 | 2/2014 | Zhang | |
| 2016/0053985 | A1 | 2/2016 | Wang | |
| 2017/0073048 | A1 | 3/2017 | Butcher | |
| 2018/0009513 | A1 | 1/2018 | Christensen | |
| 2018/0362126 | A1 | 12/2018 | Christensen | |

OTHER PUBLICATIONS

PlanetNautique Forums, "Science project of the month—100W underwater LED," (Sep. 5, 2014), https://www.planetnautique.com/vb5/forum/nautique-topics/maintenance . . . div-articles/30850-science-project-of-the-month-100w-underwater-led.

U.S. Appl. No. 15/206,190, filed Jul. 8, 2016, Office Action dated Mar. 22, 2018.

U.S. Appl. No. 15/206,190, filed Jul. 8, 2016, Office Action dated Nov. 8, 2017.

U.S. Appl. No. 16/109,480, filed Aug. 22, 2018, Office Action dated May 22, 2019.

U.S. Appl. No. 16/109,480, filed Aug. 22, 2018, Office Action dated Oct. 10, 2019.

United States District Court Middle District of Florida Tampa Divisional, "Defendant Ancient Brands, LLC's Preliminary Non-Infringement Contentions" 163 pages.

United States District Court Middle District of Florida Tampa Divisional, "Defendant Ancient Brands, LLC's Preliminary Invalidity Contentions" 560 pages.

* cited by examiner

HIGH-OUTPUT MULTIFUNCTION SUBMERSIBLE MARINE LIGHTING APPARATUS

CROSS-REFERENCE TO RELATED APPLICATIONS

This application is a continuation-in-part of U.S. patent application Ser. No. 16/109,480, filed Aug. 22, 2018, which is a continuation-in-part of U.S. patent application Ser. No. 15/206,190, filed Jul. 8, 2016, now abandoned, the disclosures of which are incorporated by reference in their entirety.

BACKGROUND

This invention relates to lighting systems and apparatus and in particular, to a submersible marine lighting system and apparatus.

Submersible lights have been used on ships and watercraft for decorative and functional purposes for decades. Lighting has been applied to decks and hulls of watercraft to improve visibility during the night, to illuminate murky waters, and to shine from a distance.

These marine lighting systems have taken many forms. Thru-hull mounted lights comprising high intensity incandescent light bulbs contained within a housing are known in the art. Light shields to redirect the light rays along the surface of the hull are known.

Numerous aspects of prior art systems include deficiencies or characteristics that are undesirable in many use cases. For example, many marine lighting products are not fully waterproof, particularly in marine conditions. This presents issues for lighting designed to be used directly in or in the immediate vicinity of water.

Another issue with prior art marine lighting is that marine lights above the waterline fade rapidly as the light source reaches the waterline. Some marine lights are integrated into the hull of a boat by placing the lights into thru-hull fittings positioned below the waterline to improve visibility in the surrounding water. By placing the light assembly inside a thru-hull, maintenance can be conducted interiorly to the boat where access is more easily facilitated than outside the boat. However, hull integrity is permanently compromised by the large cylindrical thru-hull frequently required for prior art through-hull mounting systems.

Additionally, traditional marine lighting is static in color and cannot be configured to strobe or flash. Traditional ski boats and pleasure boats operate using 12-volt electrical systems. Such systems do not have the voltage output necessary to optimally power marine lighting with up-voltage conversion. Because the output desired by boaters from submersible marine lights is more than can typically be provided by a single marine light at 12 volts, boaters traditionally position a plurality of lights on the hulls of vessels to increase collective output, an inefficiency necessitated by weakness in the art.

With the advent of light emitting diode (LED) based illumination, LED arrays are rapidly replacing incandescent bulbs as preferred illumination sources. Thus, there exists a need in the art for an LED based, submersible lighting system that is affixable to the hulls of boats and that does not compromise the integrity of the hulls. Further, it is desirable to have such systems configurable to shine in any number of colors or flashing patterns and to diffuse higher intensity light than conventional apparatus.

Traditional marine lighting applications have also failed to address the need for lighting that can be directionally focused while still maintaining a waterproof housing. Current solutions for focused, directional marine lighting are limited above-the-water solutions that require a user to manually aim or point the light in a desired direction. Thus, a need exists in the art for submersible marine lighting that can do more than simply transmit unfocused light that is easily diffused.

Traditional marine lighting applications have also failed to address the need for cooling such apparatus in an efficient and elegant manner. For example, lights such as those in U.S. Pat. Pub. No. 2017/0073048 require housing units that allow water to enter into the interior of the housing unit so that the water can directly contact a specific heat sync adjacent to the light source.

In other prior art lights, closed loop liquid cooling is utilized where an LED array first transmits heat into a liquid within a closed tubing system. The tubing system then extends through the waterproof housing containing the LED array, where it is then contacted by the environment to dissipate heat. This solution is undesirable because it introduces significant complexity to the cooling system, including introducing additional points of failure where water could be introduced to the LED array area.

Thus, it is apparent that improved submersible marine lighting apparatus are needed. The embodiments described herein are not limited to addressing the aforementioned limitations in the art.

SUMMARY

From the foregoing discussion, it should be apparent that a need exists for a multifunction submersible marine lighting apparatus. Beneficially, such lighting apparatus would overcome many of the difficulties and concerns expressed above by providing a multifunction marine lighting apparatus that can be easily installed with multiple lighting functions.

The present invention has been developed in response to the problems and needs in the art that have not yet been fully solved by currently available apparati and methods. Accordingly, the present invention has been developed to provide a submersible light comprising: a base for affixation to a hull of a watercraft, the base defining a recess for receiving an LED array; an LED array; a thermal switch; a plano-convex lens disposed between the base and a retaining ring for focusing light diffusing from the LED array, the plano-convex lens having a circumscribing flange; wherein the retaining ring is bolted to the base by a plurality of screws. The apparatus may further comprise a reflector disposed between the plano-convex lens and the base.

A second submersible marine light is provided comprising: a cylindrical base for affixation to a hull of a watercraft, the base defining a recess for receiving an LED array; an LED array; a thermal switch in logical connectivity with the LED array; a plano-convex lens disposed between the base and a retaining ring for focusing light diffusing from the LED array, the plano-convex lens having a circumscribing flange; a lens gasket disposed around and at least partially enclosing the circumscribing flange of the plano-convex lens and forming a seal between the base and the retaining ring; wherein the retaining ring is bolted to the base by a plurality of screws. The lens gasket includes a lower portion that is received within the recess of the base and an upper portion received within a recess in the retaining ring. The retaining ring includes an interior ledge that overhangs and engages the top portion of the lens gasket to compress the gasket between the base and retaining ring and thereby form a watertight seal therebetween. Cooperation of the base, lens, lens gasket, and retaining ring form a sealed watertight unit, as illustrated in the drawings and described more fully hereafter.

These features and advantages of the present invention will become more fully apparent from the following description and appended claims, or may be learned by the practice of the invention as set forth hereinafter

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1A:
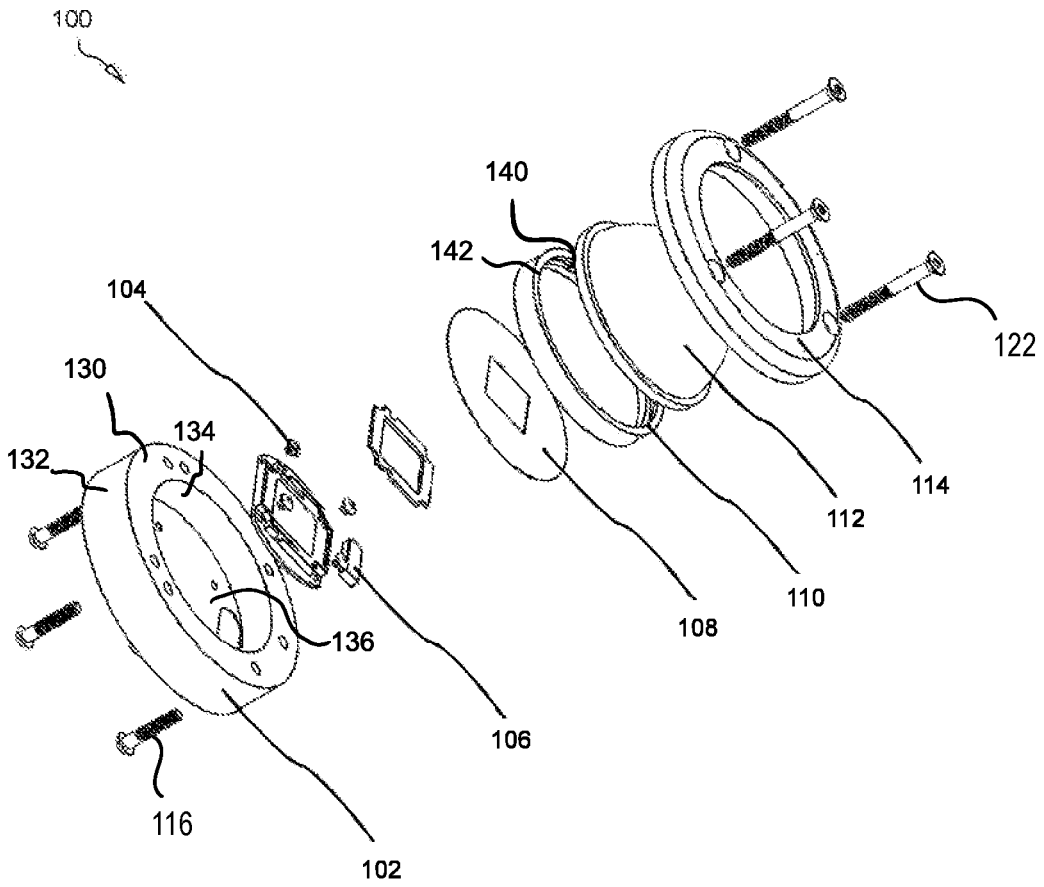
FIG. 1A is an exploded elevational perspective view of an example submersible marine lighting apparatus with selected elements labeled for elucidation.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

FIGS. 1-7 illustrate embodiments and features of submersible marine lights in accordance with embodiments of the present invention. FIGS. 1A-1B are exploded elevational perspective views illustrating a disassembled submersible marine light 100. Light 100 comprises a base 102, button head cap screws 104, a thermal switch 106, a reflector 108, a focus lens gasket 110, a focus lens 112, a retaining ring 114, button head cap screws 116*a-d*, an LED array 118, a reflector gasket 120, and flat head cap screws 122*a-c*. Lens gasket 110 includes an interior groove or recess 140 configure to receive a circumscribing flange of focus lens 112 and a sealing flange 142 positionable over the circumscribing flange.

As illustrated in the drawings, base 102 comprises a cylindrical housing member with a bottom surface, a top surface 130, an exterior perimeter wall surface 132, an interior perimeter wall surface 134, and a recess base surface 136. Top surface 130, interior perimeter wall surface 134, and recess base surface 136 define a recess that allows LED array 118 and thermal switch 106 to be received and installed within base 102. A specialized recess in recess base surface 136 is configured to receive thermal switch 106. LED array 118 can be thermally coupled to base 102, which can act as a heat sink for LED array 118.

Figure 1B:
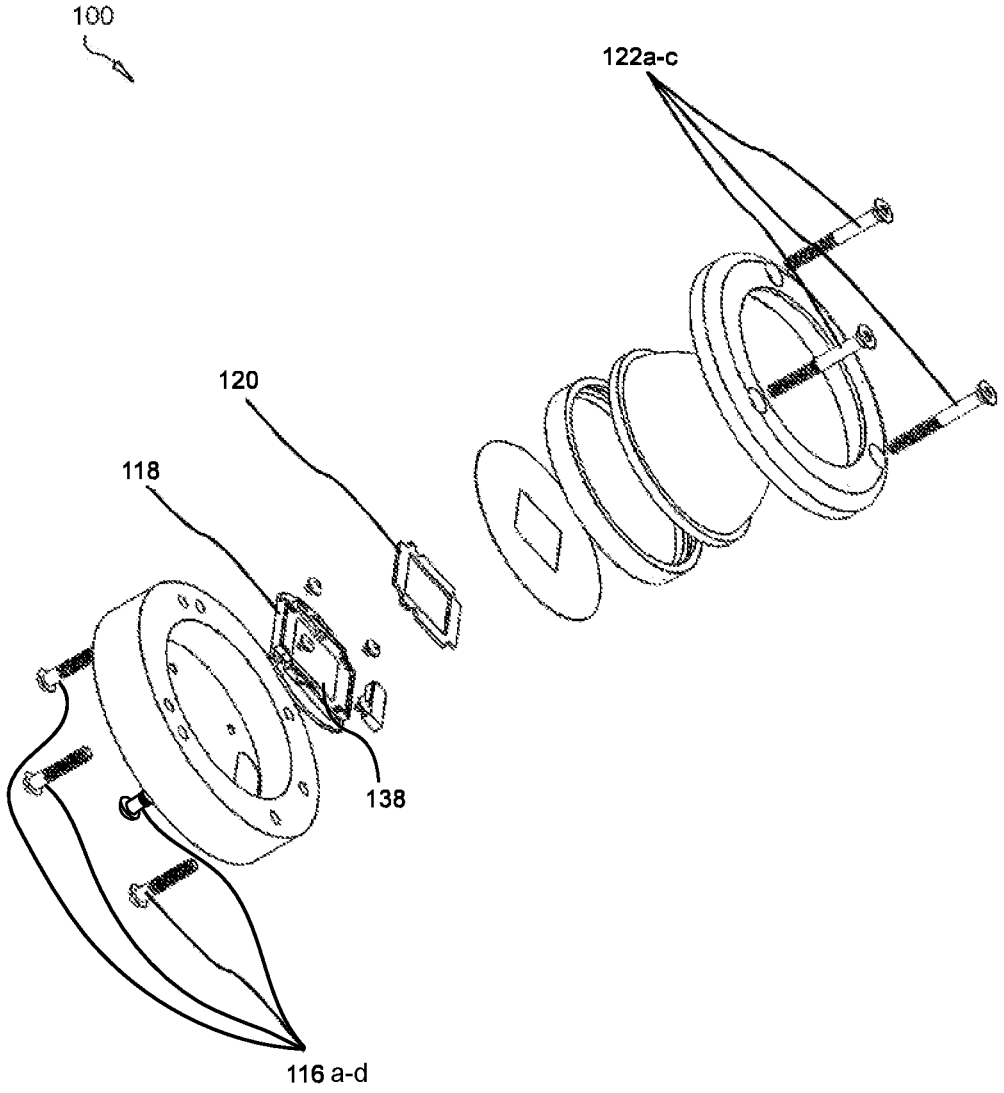
FIG. 1B shows the same exploded perspective view of the submersible marine lighting apparatus as in FIG. 1A with other selected elements labeled for elucidation.

As seen in FIGS. 1A and 1B, the recess in base 102 is configured to receive a lower portion of lens gasket 110. Retaining ring 114 includes a corresponding recess configured to receive an upper portion of lens gasket 110 and a flange that overhangs and engages sealing flange 142 of lens gasket 110. When compressed between base 102 and retaining ring 114, lens gasket 110 cooperates with base 102 focus lens 112, and retaining ring 114 to form a sealed watertight unit, as illustrated in, e.g., FIGS. 4 and 5. As illustrated, retaining ring 114 can be in direct contact or otherwise thermally coupled with base 102 to assist in conducting heat away from LED array 118. When submerged in water, base 102 and retaining ring 114 can efficiently dissipate heat into the surrounding water.

As illustrated in FIGS. 1A, 1B, 2, 4, 5 and 6, base 102 (502) can be bored, drilled, or otherwise configured to define a plurality of threaded and unthreaded apertures for receiving button head cap screws 104, button head cap screws 116*a-d*, and flat head cap screws 122*a-c*. As further illustrated in FIG. 2, base 102 includes a plurality of unthreaded countersunk apertures 202*a-d* for receiving button head cap screws 116*a-d*. By being countersunk, the heads of button head cap screws 116*a-d* do not protrude past the bottom surface of base 102 so as to not interfere with flush mounting of marine light 100, 200 to a watercraft surface.

As readily and unambiguously inferred from FIGS. 1-7, the threaded ends of button head cap screws 116*a-d* are received in corresponding tapped threaded apertures (not shown) that open through the bottom, but do not extend through the top, of retaining ring 114. In this way, cooperation between button head cap screws 116*a-d*, base 102, retaining ring 114, lens gasket 110, and lens 112, form an assembled, sealed, waterproof, and thermally conductive configuration of marine light 100. When lens gasket 110 is partially compressed between opposing interior surfaces of base 102 and retaining ring 114, it forms a water-tight seal that prevents water from passing into the interior of the light (e.g., through interface 512 between base 502 and retaining ring 114). When submersible marine light 100 is attached to the side of a watercraft, the base and the watercraft can cooperate to shield button head cap screws 116*a-d* from water and prevent or minimize corrosion, which maintains a waterproof seal to protect electrical components inside the sealed unit.

It is appreciated that base 102 is advantageously formed from a thermally conductive material to conduct heat from the LED array to surrounding water than marine light 100 is submerged in or exposed to water. For example, base 102 and may be formed from aluminum, stainless steel, titanium, metal alloys (e.g., brass), or other materials known to those of skill in the art. It will be appreciated that base 102 can function as a conductor to extract heat away from LED array 118 during use. For example, rather than requiring an independent heat sync thermally coupled to LED array 118, base 102 can be configured to both house LED array 118 and function to conduct away heat generated by LED array 118 into the environment through the surrounding water. Retaining ring 114 can also be make from the same or different thermally conductive material as base 102 and, when thermally coupled to base 102, can assist in conducting heat away from LED array 118. In this way, it is possible to efficiently and reliably cool marine light 100 without having to pass water through an interior of the light.

This is particularly beneficial as light 100 (400, 500, 600) is configured to be placed below the water line on the exterior of a watercraft. In so doing, base 102 will be surrounded by water, allowing the heat extracted by base 102 from LED array 118 to be conducted directly into the surrounding water. By utilizing the housing unit directly as a heat sync, the need for other, more complicated cooling methods is reduced or eliminated. For example, some prior art lights (e.g., U.S. Pat. Pub. No. 2017/0073048) involve allowing water to flow through a portion of the housing in order to contact a dedicated heat sync attached to the light source.

Such prior art cooling systems may be undesirable for several reasons. First, bodies of water in which submersible lighting are used will almost certainly include debris, organic matter, salt, or substances other than simply the water itself. By introducing these pollutants into the housing of the device—particularly to provide the important task of cooling the light source—the likelihood of failure is increased. For example, a port that allows water to enter the housing to cool the heat sync may become clogged, thereby blocking the inflow of cooling water. Additionally, even if there is no clog, pollutants may become deposited on the interior surface of the housing, including the heat sync, reducing the cooling effect and potentially leading to premature failure of the device. Salt may promote corrosion of the light from the inside out.

Another primary concern of any submersible lighting apparatus is its ability to remain sealed and watertight. While prior art systems that allow some internal portions to directly contact water may be effective in reducing heat, they also increase the complexity of such designs and introduces additional potential points of failure (e.g., leak points, debris, etc.)

To address these issues, some embodiments of the present invention include providing a direct thermal connection between LED array 118 and housing 102 such that heat can be efficiently conducted away from LED array 118 into housing 102 and then directly into the surrounding water. One having skill in the art would understand that a conductive material may be utilized between LED array 118 and base 102. For example, a thermal paste may be utilized to more efficiently conduct heat away from LED array 118 and base 102.

It should also be appreciated that the illustrated device provides a very efficient housing shape for heat management. Unlike prior art systems, a single, substantially circular base is configured such that a single LED array 118 can be placed centrally within base 102. In so doing, heat generated by LED array 118 is most efficiently conducted into base 102 (and optionally also into retaining ring 114) and then into the surrounding water. It is appreciated that having a dedicated heat sync surrounding each LED array will more efficiently dissipate heat than prior art systems that utilize a bank of LED arrays within a singular housing. For example, some prior art systems utilize a singular rectangular housing with rows of lights inside the rectangle. Such a shape will less efficiently dissipate heat.

Figure 7:
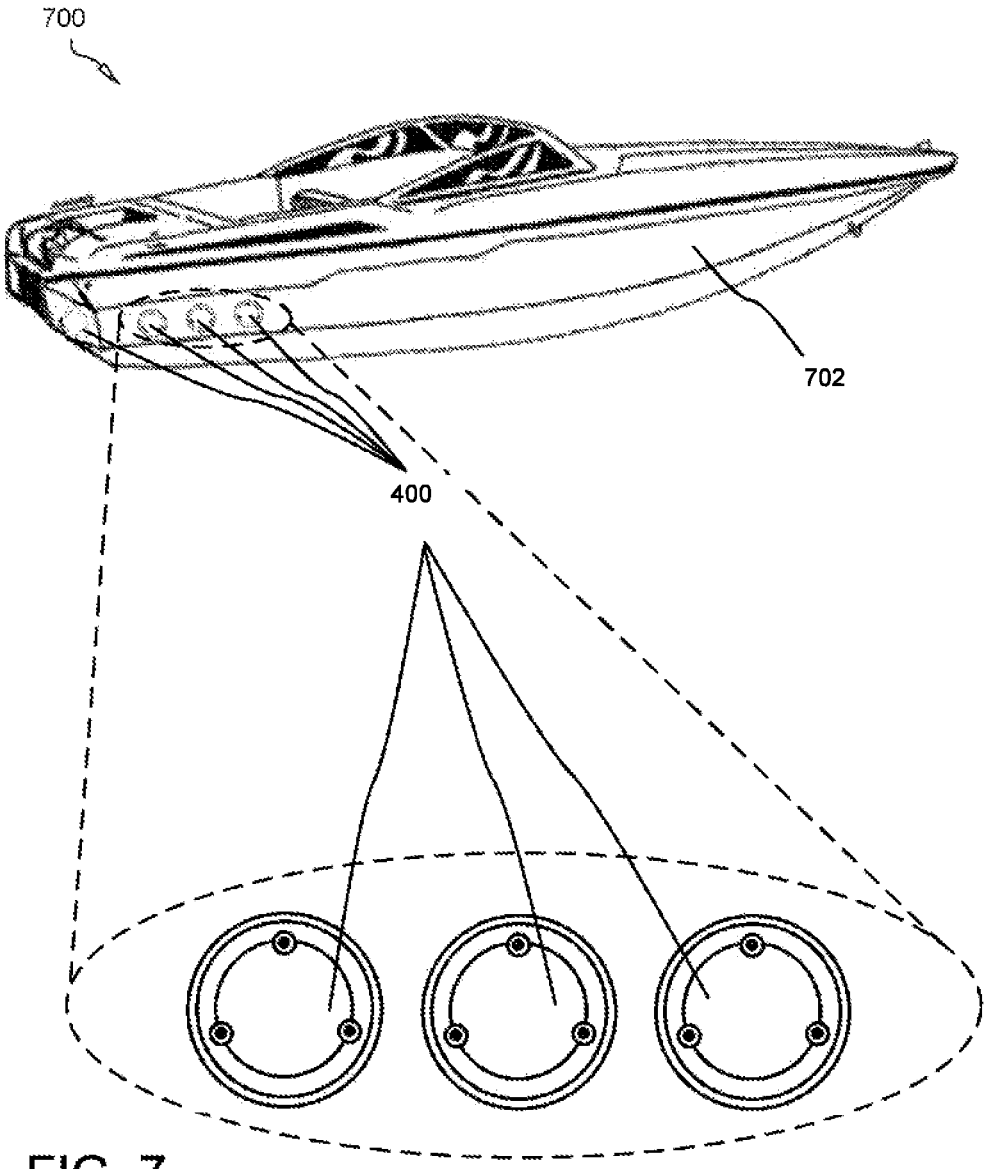
FIG. 7 is an exploded environmental side perspective view illustrating placement of a plurality of submersible marine lights on a side of a watercraft.

The shape of base 102 also allows light 100 to be placed in locations on a watercraft that prior art solutions would be ill suited for based on their physical shape and size. For example, as illustrated in FIG. 7, one or more lights 400 (100, 500, 600) may be placed on the side of a watercraft. Lights 400 can be attached to the watercraft using various means, including one or more of marine adhesive, self-tapping (e.g., wood) screws that directly engage structural material (e.g., fiberglass) of the watercraft, or machine screws that pass through holes and are secured by washers and nuts on the opposite wall surface inside the watercraft. The marine adhesive adheres the bottom surface of base 102 to the watercraft and forms a seal that prevents or minimizes water from contacting screws 116. This prevents corrosion of the screws, minimizes or prevents galvanic voltage between different metals, and enhances the life of the marine light assembly.

Because base 102 is circular, water drag across light 100 is minimal, particularly as compared to prior art solutions that are often large rectangular banks of lights. Additionally, because base 102 functions as both the housing and the heat sync, the overall distance light 100 protrudes away from the hull of the watercraft is reduced as compared to prior art systems. Further, in scenarios such as the one described above, when light 100 is positioned in a location where water drag is an issue (e.g., on the side of a hull), there is increased concern that water may be forced into portions of the light 100 that need to remain water tight. The disclosed marine lights provide a solution to this potential problem.

As will be appreciated, the size (both depth and diameter) of the recess within base 102 allows for placement of the LED array and other components in light 100 in different positions relative to the other components of light 100. As one non-limiting example, a base 102 with a recess height of between 10 mm and 25 mm may yield a light 100 with an LED array 118 installed in a location that is closer to other components, for instance focus lens 112, than would an LED array 118 in a different base with a 25 mm to 50 mm recess height. This is possible because, in various embodiments, the base 102 is bored, drilled or otherwise configured to define a plurality of tapped threaded apertures for receiving threaded ends of button head cap screws 104. Using these attachment points, elements such as LED array 118 and thermal switch 106 can be securely mounted inside the recess in base 102 in a desirable location relative to top surface 130 of base 102. It is also appreciated that to maintain a watertight enclosure, in some embodiments the attachment points (e.g., tapped threaded apertures for receiving threaded ends of button head cap screws 104) do not extend entirely through recess base surface 136.

LED array 118 may comprise a chip on board (COB) system. In various embodiments, the COB LED array 118 is powered by 25 or 34 volt or higher input to produce optimal light output from the light 100, distinguishing the present invention from lower-output lights in the art. In some embodiments, COB LED array 118 can be powered by 24-volt nominal, 36-volt nominal, 48-volt nominal, 60-volt nominal, or other higher nominal voltage input to produce optimal light output from the light 100. Twelve-volt boat, watercraft or vessels electrical systems may be up-converted to higher voltage(s) using means known to those of skill in the art, including transformers, converters, boosters, and the like. In various embodiments, the light 100 is powered by a separate fan box 800 (further described below).

It is appreciated that the aforementioned operating voltages are non-limiting and are expressed in nominal values to account for the fact that different LED arrays may operate at slightly different preferred voltages. For example, a 24-volt nominal LED array may operate within a range of anywhere between 20 volts to 28 volts. Similarly, a 36-volt nominal LED array may operate in a range such as 33 volts to 40 volts, depending on the configuration. As such, one having ordinary skill in the art would recognize that nominal values function as a rough approximation of the type of LED array and should not be interpreted as limiting the invention to configurations that operate only at those specific voltages.

In some embodiments light output from the light 100 is further amplified (or focused) using the focus lens 112, which directs light diffused from the LED array 118 into a more focused beam emitting from the focus lens 112.

This ability to focus the light emitted by the LED array greatly improves some applications of light 100. As described above, focusing may be accomplished using a focusing lens, such as plano-convex lens 112, that is manufactured to collect light from LED array 118 and focus the light according at a desired transmission radius. In other embodiments, focusing may be accomplished by altering the physical distance between lens 122 and transmission surface 138 of LED array 118.

Whether light focusing is accomplished using a focusing lens or by increasing the distance between the lens and the light source (or through a combination of methods), it is helpful to understand and describe the mathematical principles behind the focusing effect.

For example, in an embodiment where light 100 is placed below the waterline, transmitted light quickly diffuses in all directions away from the hull. Mathematically, the 3-dimensional space in which light diffuses from a single point source is measured in steradians (i.e., three dimensional radians.) As the transmission angle of a point light at a given lumen output is decreased (e.g., becomes narrower, or more focused) the intensity of the transmission is increased. The intensity of such focusing is mathematically described in candela units.

It should be appreciated that the mathematical calculations discussed herein are included only to describe general principles rather than to calculate any required parameters of the present invention. However, by understanding the effect that certain alterations to described exemplary embodiments of the present invention, one having skill in the art would be able to understand the types of configurations that would achieve the disclosed benefits and improvements over existing solutions.

The following equation describes a relationship between transmission volume "lm" (i.e., lumens), transmission intensity "cd" (i.e., candela), and the degree of transmission angle (i.e., steradians):

$$\text{cd} = \frac{\text{lm}}{2\pi * \left(1 - \cos\left(\frac{deg^{\circ}}{2}\right)\right)}$$

Utilizing the equation above, and assuming a 1000 lumen output LED array, a light transmission from a single hemispherical point light transmission source (e.g., light 100 transmitting light uniformly at 180 degrees through a plano-convex lens) would produce output of 160 candela.

However, by reducing the transmission angle (e.g., focusing the transmitted light), the intensity of the light beam is increased without altering the lumen output of the transmission source (e.g., LED array 118.) For example, if focus lens 112 is configured to reduce the transmission angle from 180 steradians (e.g., 180 degrees in three-dimensional space or a full hemisphere) to 120 steradians, the intensity of the focused light increases to approximately 318 candela. Thus, as is appreciated by the forgoing example, reducing the transmission angle by one third (i.e., 180 steradians to 120 steradians) results in almost doubling the intensity of the light beam (i.e., 160 candela to 318 candela.)

Thus, to increase the intensity of the output of light from light 100, the light is focused to thereby reduce the transmission angle of light exiting the apparatus. Depending on the embodiment, this focusing is accomplished using one or more techniques.

As described above, in one embodiment, light 100 may be configured to transmit light evenly across 180 steradians. This may be accomplished by placing the transmission surface, for example transmission surface 138 of FIG. 1B, of LED array 118 so that it is substantially coplanar with surface 130 of based 102. By placing LED array 118 in this position, substantially all light produced by the array is transmitted evenly in all directions into the surrounding environment. Notably, in this embodiment, reflector 108 functions to ensure that light that is internally reflected (e.g., by lens 112) is not entirely lost but is redirected to exit the apparatus.

In another embodiment, LED array 118 is offset within base 102 in a position that places transmission surface 138 somewhere behind top surface 130 of base 102 (e.g., behind being designated as toward the bottom of base 102 and away from the lens.) In so doing, the transmission angle of LED array 118 is not a full 180 steradians as in the previous example but is some number less than 180 steradians, depending on the offset distance.

This reduction in transmission angle results in a more focused light beam exiting the apparatus. As discussed in conjunction with the candela formula above, because the transmission power of the LED array 118 has not been altered but the transmission angle has been reduced, the intensity of the focused beam is increased (i.e., the candela value is increased).

Thus, in one embodiment, a light 100 is configured such that the inner diameter of the recess of base 102 at the top surface 130 is approximately 150 mm. Notably, the height of the interior of the recess may be uniform, or it may be some other shape such as a tapered shape or a conical shape.

For the sake of understanding the resultant light intensification that occurs from modifying the distance between LED array 118 and the lens, a primary variable is the aperture of the opening through which transmitted light passes prior to reaching the lens. To approximate that modified transmission angle, trigonometry can be utilized using the offset distance between the LED array surface and the bottom of the lens (approximated, in this example, as being the same as the inner diameter of the recess of base 102 at the top surface 130 onto which the lens is mounted.)

Continuing with this example, LED array 118 is located within base 102 such that transmission surface 138 of LED array 118 is about 12.5 mm below top surface 130 of base 102. This may be accomplished, for example, by increasing the height of exterior surface 132 of base 102 such that interior surface 130 has a height of 12.5 mm plus the thickness of LED array 118 and necessary mounting hardware.

Finally, a lens 112 is attached to base 102 such that the diameter of the base of the lens approximately matches the recess diameter of 150 mm. As illustrated, the lens may also include a circumscribing flange (e.g., flange 304 illustrated in FIG. 3) in order to secure lens 112 to base 102 in a suitable manner.

According to this embodiment, the transmission angle would be reduced from 180 steradians (e.g., when the surface of LED array 118 is coplanar with top surface 130) to about 160 steradians. Accordingly, the candela measurement for this embodiment would be increased from about 160 candela to about 190 candela.

For the sake of additional illustration of the effect of increasing the distance between LED array 118 and lens 112, in a second embodiment the surface of LED array 118 is located within base 102 such that it is offset approximately 25 mm rearward from top surface 130. Assuming all other factors remain the same from the previous example, the transmission angle would be reduced to about 143 steradians (as compared to 160 in the prior example) increasing the output to about 233 candela (as compared to 190 candela in the prior example.)

As can be appreciated by the foregoing, non-limiting, examples, by configuring light 100 to allow placement of LED array 118 at different distances from top surface 130, the output characteristics of light 100 can be modified to produce different focusing characteristics with desirable candela values.

In other embodiments, base 102 may remain constant, but other aspects of light 100 may be altered. For example, focus lens gasket 110 may be configured such that focus lens 112 is farther from transmission surface 138 of LED array 118. In such embodiments, the aforementioned focusing of light (and corresponding candela increase) from LED array 118 is still accomplished but done in a manner that utilizes a uniform base 102.

In another embodiment, a combination of placing the LED array transmission source farther inside base 102 and extending the distance of a lens farther from the LED array may be utilized. For example, in an embodiment, LED array 118 is placed 12.5 mm from top surface 130 into base 102, while focus lens gasket 110 is configured to place focus lens 112 about 12.5 mm from top surface 130. As can be appreciated, the combination of these configurations places the transmission surface 138 of LED array 118 approximately 25 mm from the bottom surface of lens 112, effectively producing the same focusing effect previously described.

In some embodiments, light 100 may be configured in a manner that allows the distance between the transmission surface 138 of LED array 118 and the bottom surface of a lens, such as focus lens 112 to be adjustable. For example, in some embodiments, focus lens gasket 110 may be configured such that it can be rotated. As illustrated in FIGS. 1A and 1B, focus lens gasket 110 may include an interior recess 140, such as with threading, configured to receive the circumscribing flange of focus lens 112, and a flange 142 positioned over the circumscribing flange. In this way, lens gasket 110 receives and at least partially encloses the top surface, bottom surface, and outer perimeter surface of the circumscribing flange.

As one having ordinary skill in the art would recognize, internal threading 140 could then be configured such that as focus lens gasket 110 is rotated, focus lens 112 is caused to be moved closer or farther from base 102 depending on the rotation direction. In this manner, light 100 may be adaptable to different situations that benefits from greater light intensity (e.g., higher candela values) by increasing the distance between the transmission surface 138 of LED array 118, or for broader light diffusion when the distance is reduced.

In other embodiments, focus lens gasket 110 may include one or more fixed retaining grooves that are configured to receive a flange on focus lens 112. In such a configuration, rather than rotating focus lens gasket 110 to dynamically modify the distance between lens 112 and LED array 118, lens 112 can be fixed in place within one of the retaining grooves. While this perhaps limits the dynamic adjustability of light 100, such fixed retaining grooves may increase the reliability of light 100 by more positively positioning focus lens 112 at a preconfigured distance from the LED array.

In one corresponding embodiment, focus lens 110 may include multiple retaining grooves positioned a known distance apart, for example 5 mm each. Accordingly, the distance between focus lens 112 and the LED array can be adjusted in 5 mm increments to increase or decrease light focusing depending on the current application of light 100.

Similarly, as would be appreciated by one having ordinary skill in the art, cap screws 104 used to secure LED array 118 to recess base surface 136 may also be adjustable such that LED array 118 can be moved in relation to focus lens 112. In some embodiments, cap screws 104 may be accompanied by standoff mounts that can be positioned between the LED array assembly and the mounting surface of base 102. In this manner, the offset distance between the LED array 118 and the lens can be modified in a simplified manner using the mounting hardware rather than directly modifying the housing itself.

It should be apparent from the forgoing that while a higher output LED array would alone improve the present invention over the prior art by providing a higher output light 100 (e.g., thus eliminating the need to affix multiple lights to a hull surface) because of the candela effect and the ability to adjust the spatial relationship between LED array 118 and a lens, lower power LED arrays can be utilized while maintaining sufficiently powerful transmission beams.

For example, using the formula discussed previously, one can identify that an LED array outputting 1000 lumens focused to 160 steradians produces a focused light transmission at approximately 193 candela. However, in some embodiments, a 1000 lumen LED array may be undesirable because it draws too much power, produces too much heat, is too expensive to manufacture, or is physically too large for the desired housing size. Whatever the reason, an LED array that generates less light volume (e.g., outputs a lower lumen rating) may be utilized by reducing the transmission angle by focusing the light using one of the techniques previously discussed.

Accordingly, while a 1000 lumen LED array produces 193 candela at 160 steradians, an 800 lumen LED array is capable of producing the same intensity by focusing the light transmission to 140 steradians. In practice, this represents only 10 degrees of reduced transmission in each direction in the horizontal plane while allowing for an LED array that outputs 20% less light and requires less power.

In order to utilize the reduced output LED, light 100 must be able to accommodate increasing the distance between the LED array and the lens, as described previously. For the sake of completeness, in the scenario described reducing the LED array from 1000 lumens to 800 lumens (while maintaining approximately 193 candela), the 800 lumen LED array must be offset approximately 14 mm more from the lens than the 1000 lumen LED array.

Figure 2:
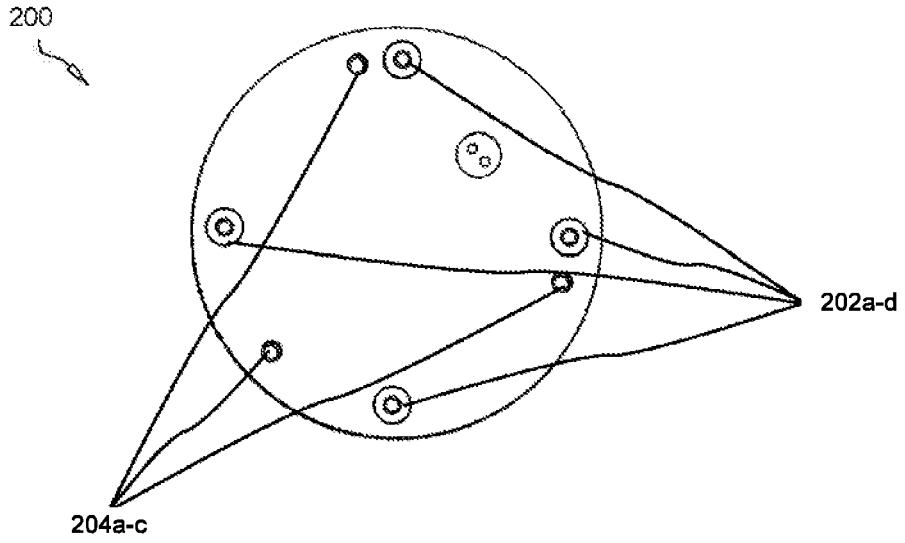
FIG. 2 is a bottom plan view of the base of the submersible marine lighting apparatus of FIG. 1A.

FIG. 2 is a lower perspective view of the base in accordance with the present invention. The base comprises a plurality of apertures 202, 204 for receiving threaded bolts. The base 102 may also comprise additional apertures for wires exiting or interconnecting the base 102 with a control box.

Figure 3:
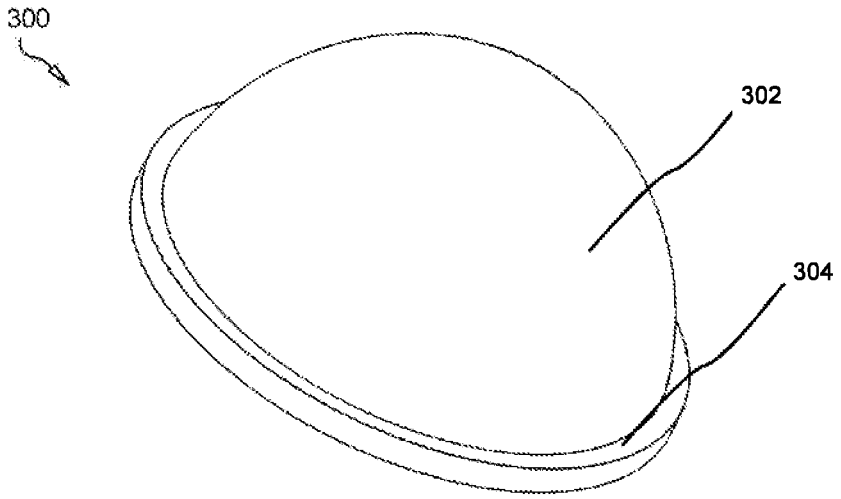
FIG. 3 is an elevational perspective view of the plano-convex lens of the submersible marine lighting apparatus of FIG. 1A.

FIG. 3 is an elevational side perspective view of a convex lens in accordance with the present invention. While FIG. 3 illustrates a traditional plano-convex lens (i.e., a lens with one flat surface and one convex surface), it is appreciated that the current invention contemplates non-standard lenses that perform light transmission affects similarly to plano-convex lenses.

Figure 9:
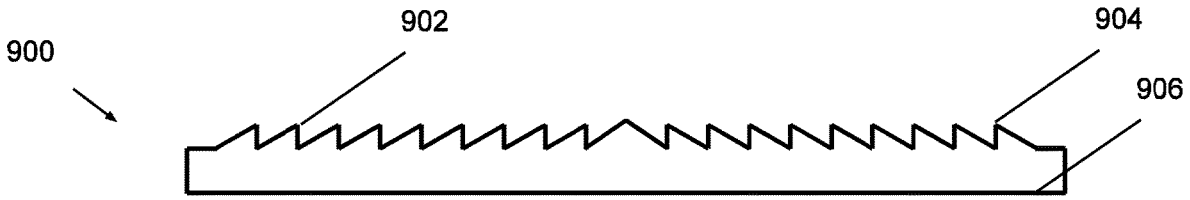
FIG. 9 is a side cross-sectional view of a Fresnel style lens that can be incorporated in some embodiments of a submersible marine lighting apparatus.

For example, in some embodiments, a Fresnel style lens may be utilized. As can be appreciated, utilizing a Fresnel style lens within light 100 would decrease the overall distance light 100 would extend away from its mounting location on the hull of a watercraft. This is because Fresnel style lenses utilize a series of concentric lens features that allow the reflective/refractive properties of a typical convex or concave lens to be achieved within a single plane. FIG. 9 includes a cross-sectional view of one configuration of a Fresnel style lens and will be discussed in detail below.

Generally, Fresnel lenses produce light output that is less optically sharp and consistent than a traditional convex lens. However, for the applications in which a light such as light 100 is typically utilized, diminished optical quality is less problematic.

On the other hand, the reduction in overall size that is possible by using a Fresnel may be highly beneficial. For example, as described previously, some embodiments of light 100 may be mounted to the side of a watercraft below the waterline. As previously described, such a mounting location will result in some amount of drag as the device travels through the water. Utilizing a Fresnel lens will reduce the overall size of the device which, alone, will reduce drag. Further, because the reduction in size occurs in the direction extending away from the hull, the drag reduction will be maximized.

Additionally, utilizing a Fresnel lens in conjunction with the illustrated retaining ring (e.g., retaining ring 114 of FIG. 1A) allows positioning of the lens entirely behind the retaining ring. In some embodiments, this is beneficial because it protects the lens by eliminating any portion of the lens that must extend beyond the retaining ring.

The focus lens 112 in convex from a top perspective view. The focus lens 112 comprises a flange 304 circumscribing the lens 112. In the preferred embodiment, the flange 304 and focus lens 112 are formed as a single integrated piece.

The focus lens 112 is disposed between the top surface of the base 102 and a bottom surface of an annular retaining ring 114.

The base 102 and retaining ring 114 may be fabricated from aluminum, stainless steel, titanium or other materials known to those of skill in the art.

Figure 4:
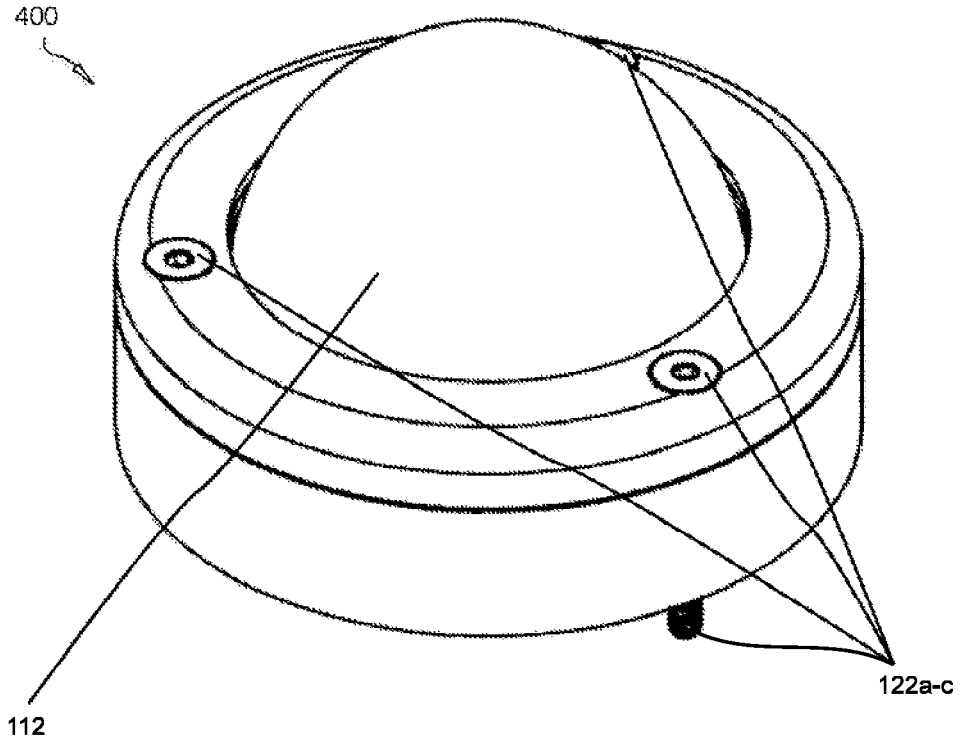
FIG. 4 is an elevational perspective view of the assembled submersible marine lighting apparatus of FIG. 1A.
Figure 4:
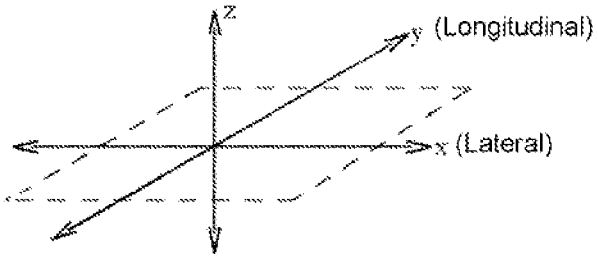

FIG. 4 is an elevational side perspective view of an assembled submersible marine lighting apparatus in accordance with the present invention.

Figure 5:
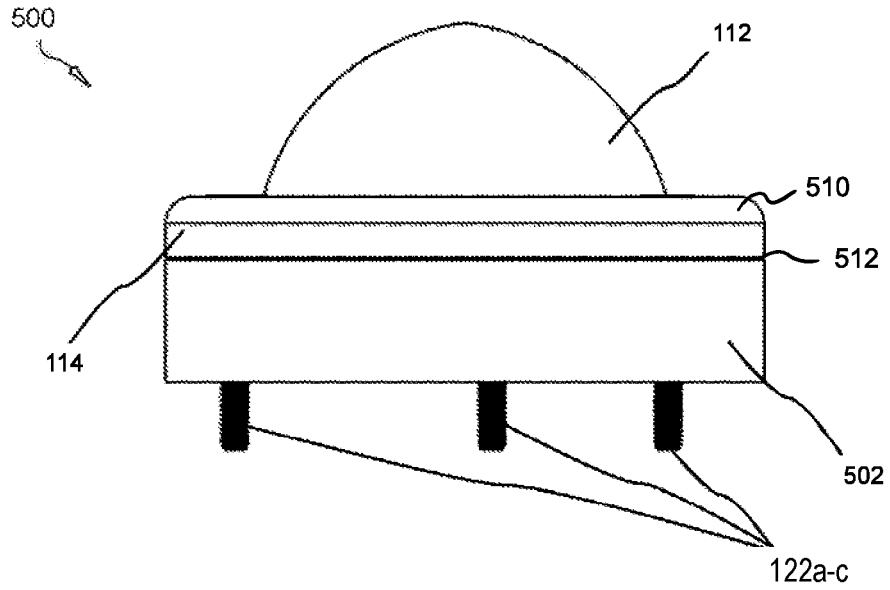
FIG. 5 is an elevation view of the assembled submersible marine lighting apparatus of FIG. 1A.

FIG. 5 is a side perspective view of an embodiment of a submersible marine lighting apparatus 500 in accordance with the present invention.

As shown, the retaining ring 114 is mounted on the base 502 around the focus lens 112. As shown in FIGS. 1-2, button head cap screws 116*a-d* are inserted through corresponding apertures 202*a-d* in base 102 and secured to corresponding tapped threaded apertures (not shown) in the bottom of retaining ring 114 to form a sealed waterproof marine light 100 prior to attachment of light 100 to the hull of a ship or watercraft. As shown in FIGS. 4-5, the threaded ends of flat head cap screws 122*a-c* extend below base 502, which can be inserted through corresponding apertures in the hull of a ship or watercraft. Corresponding nuts and washers (not shown) can cooperate with the threaded ends of flat head cap screws 122*a-c* to secure marine light 500 to the hull of the ship or watercraft.

In this embodiment, some portions of light 500 (e.g., retaining ring 114), may be configured with a profile, such as chamfer 510, or another profile configured to aid in directing water away from interface 512 between base 502 and retaining ring 114. As one having ordinary skill in the art would recognize, base 502 may also be configured to include a profile that allows reduced drag forces to be exerted on light 100 when water runs across device.

Figure 10:
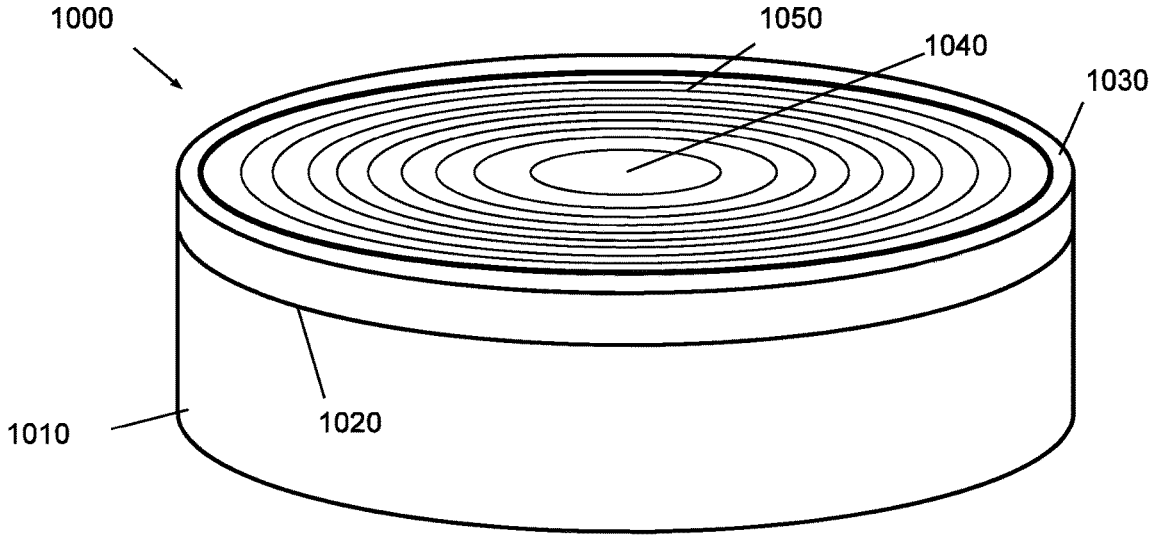
FIG. 10 is an elevational perspective view of a submersible marine lighting apparatus incorporating a Fresnel style lens.

As discussed herein, utilizing a Fresnel lens in conjunction with an embodiment, such as light 1000 of FIG. 10, reduces the profile of light 1000. Such profile reduction can be beneficial, in some embodiments, to reduce water drag, protect sensitive lens material (e.g., glass, plastic, or other suitable lens material), and potentially to reduce overall weight and mounting requirements for the 1000.

Figure 6:
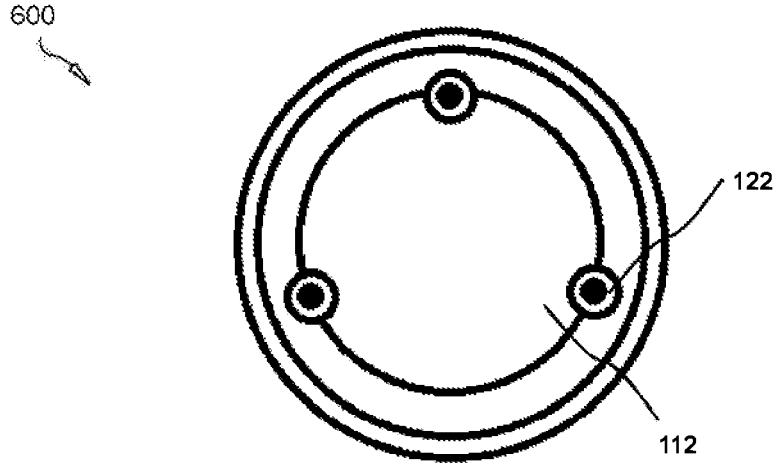
FIG. 6 is a top view of the assembled submersible marine lighting apparatus of FIG. 1A.

FIG. 6 is a top plan view of a submersible marine lighting apparatus 600 in accordance with the present invention showing the tops of flat head cap screws 122 and focus lens 112.

FIG. 7 is an exploded environmental side perspective view of submersible marine lights 400 in accordance with the present invention. Lights 400 may be disposed alongside the hull of a boat 702 or on the stern below the waterline.

Figure 8:
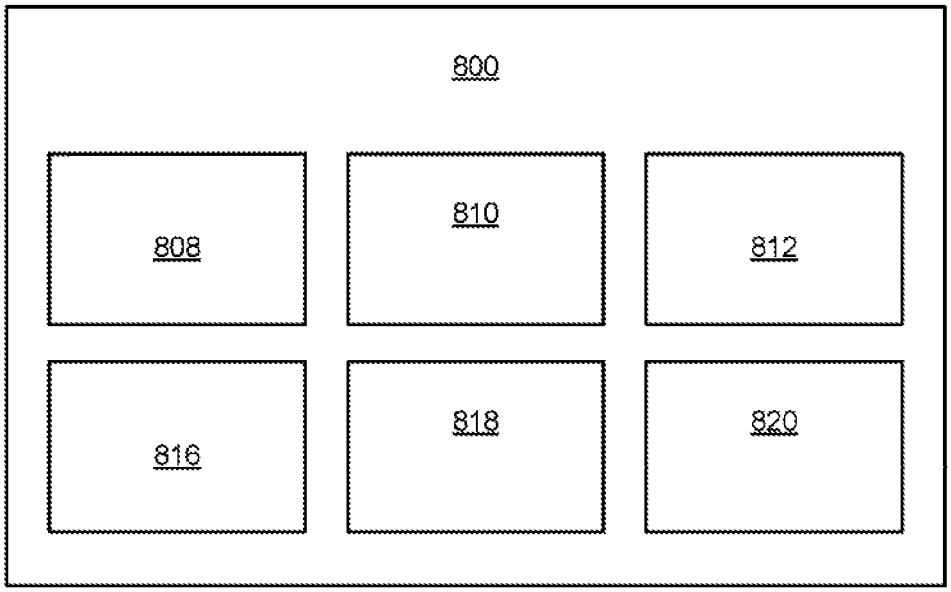
FIG. 8 is a block diagram of a fan box for controlling input to a submersible lighting apparatus in accordance with the present invention.

FIG. 8 is a block diagram of a fan box 800 for controlling input to a submersible light in accordance with the present invention. One having ordinary skill in the art would appreciate that the elements described within fan box 800 may be configured in any suitable manner to provide the functions of the illustrated components.

In some embodiments, fan box 800 is configured to be installed on the interior of the hull of a watercraft and then electrically connected to a submersible light apparatus that is attached on the exterior of the hull below the waterline. In order to accomplish this, in some embodiments, electrically conductive wiring will pass through apertures created in the hull and then into the submersible light. For example, fan box 800 may be connected to a submersible light 100 as shown in FIGS. 1-6. Further, as shown in FIG. 2, the electrical connection between fan box 800 and light 200 may be accommodated through access holes within the base of light 200 that provide an opening to then attach the wiring to a light array, such as LED array 118.

In various embodiments, fan box 800 may include a voltage up-converter with thermal protection, short circuit protection, and under voltage protection. In some embodiments, one or more of these components may alternatively be housed within the light assembly mounted on the exterior of the watercraft, for instance one or more of the components may be housed either in the recess defined by the base 102 or a separate fan-cooled housing 800 configured to be operable wirelessly. Regardless of the location of the individual components, each of the components is configured to maintain a suitable electrical connection such that each component is able to provide its intended function.

In some embodiments, fan box 800 includes a cooling fan that is operable to cool other components within fan box 800 that generate heat as a by-product of their function. In some embodiments, the fan may be a 92 mm cooling fan 810 as characterized by the diameter of the cooling element.

Fan box 800 is configured to be connected to the electrical system of the watercraft in which the box installed. For example, fan box 800 may be electrically connected to the battery of a watercraft.

In embodiments, the fan box may be configured to include a voltage up converter 816 to increase the voltage received from the electrical system of the watercraft to match the requirements of the submersible lighting apparatus. For example, voltage up converter 816 may be configured to receive a 12-volt input from the internal electrical system of the watercraft (e.g., from a 12-volt battery) and internally up convert the voltage for example to 24 volts nominal, 36 volts nominal, 48 volts nominal, 60 volts nominal, or even higher as necessary.

In various embodiments, fan box 800 comprises an extruded aluminum box. In other embodiments, fan box 800 is made from other suitable metals. Due to the internal functioning of certain components, the physical housing of fan box 800 may function to dissipate heat away from the internal componentry to improve reliability and maintain a safe operating temperature within the housing.

In some embodiments, fan box 800 includes a wireless transceiver 812 connected to a master switch 808, such as a 30-amp master switch 808, that can be controlled wireless, such as by a wireless fob 818, IR connection, wifi connection, or bluetooth connection. For example, wireless transceiver 812 can be configured to receive wireless radio communications originating from outside of fan box 800 that function to activate fan box 800 and provide electrical power to the connected lighting apparatus.

In embodiments implementing wireless transceiver 812, a wireless fob 818 may be included. Wireless fob 818 is configured to transmit (and, in some embodiments, receive) radio signals to wireless transceiver 812 to activate certain functionality within fan box 800, such as turning fan box 800 on or off. Wireless fob 818 can be a small electronic device, such as a key fob, that is activated by a user of the watercraft remotely from fan box 800, for example, from the driver's seat of the watercraft. It is appreciated that wireless fob 818 may include various buttons, switches, or other physical characteristics that allow it to transmit commands to wireless transceiver 812 to perform corresponding functionalities.

In some embodiments, wireless fob 818 includes a master on function and a master off function that fully activates or deactivates, respectively, a lighting apparatus connected to fan box 800. In other embodiments, wireless fob 818 and corresponding wireless transceiver may be connected to a function module 820 to enable more advance features. In some embodiments, function module 820 may be configured to selectively activate/deactivate one or more of several different lights attached to the hull of the watercraft.

Although a fob 818 is provided as an example of wireless remote control that permits a user to control the functioning of fan box 800 and connected lighting apparatus, other wireless devices can be uses, such as wifi and/or Bluetooth enabled devices. The wireless remote control can be one or more touch pads in the boat near the driver's seat or elsewhere, smart phones, tablet computers, hand-held remote controls with multiple function buttons, and the like.

In some embodiments, function module 820 may be configured to provide customized behaviors for multiple lights. For example, strobe, flash, dimming, colors, or other lighting features may be implemented. In some embodiments, function module 820 may be configured to alter the functionality of attached lights based on their mounting location on the watercraft. For example, function module 820 may cause lights mounted on the starboard side of the hull to behave in one way while lights mounted to the port side of the hull behave another way. For example, in one embodiment, function module 820 causes lights on the starboard side of a watercraft to emit green light while lights on the port side emit red light.

FIG. 9 illustrates a cross-sectional view of an example Fresnel style lens 900. Lens 900 includes a surface 906 and a series of concentric rings, including ring 902 and ring 904. Because lens 900 is shown in cross sectional view, the side elevation of each ring is visible. As is appreciated, each concentric ring, in this exemplary embodiment, includes an angled portion and a vertical portion. By configuring the rings in this manner, light may be reflected and/or refracted in a manner that produces light output similar to a traditional convex lens. However, as is also appreciated, the overall cross-sectional volume of lens 900 is greatly reduced as compared to a convex lens, for example lens 302 of FIG. 3. One having ordinary skill in the art would recognize that a Fresnel style lens may be produced that is capable of affecting light output in a manner that can be compared to many traditional convex lenses. This may be accomplished through varying the number of concentric rings, the width of the vertical portion, the width of the angled portion, the distance between the rights, or by other known methods.

It is also appreciated that surface 906 may be a top surface or a bottom surface depending on how the lens 900 is being utilized. For example, as will be discussed more fully in conjunction with FIG. 10, lens 900 may be oriented such that transmitted light first passes through the portion of lens 900 that includes the profiles of the concentric rings and then exits lens 900 at surface 906. In other embodiments, light may first pass through surface 906 and exit at the surface that includes the profiles of the concentric rings 902 and 904.

Turning now to FIG. 10, one embodiment of an assembled marine lighting apparatus 1000 is illustrated. Apparatus 1000 includes a base 1010 and a retaining ring 1030 that retains a lens 1040. As can be appreciated, lens 1040 includes concentric rings 1050 that correspond generally to the concepts discussed in conjunction with rings 902 and 904 of lens 900.

Light apparatus 1000 also includes a lens gasket 1020 disposed between base 1010 and retaining ring 1030 and, similar to lens gasket 110 of light 100 in FIGS. 1-6, functions to provide a waterproof seal between the lens, retaining ring, and base.

In one embodiment, lens 1040 is oriented in apparatus 1000 such that a flat surface of lens 1040 is exposed to the external environment. For example, as was discussed in conjunction with lens 900, lens 1040 may expose a flat surface similar to the surface 906. In the case of apparatus 1000, having a flat surface of a Fresnel style lens exposed to the external environment may be advantageous as compared to exposing the surface with the concentric ring profiles. For example, a flat surface may introduce less drag as the apparatus 1000 moves through the water. Additionally, a flat surface may be easier to clean (and keep clean) than a surface with significant profile variation. Additionally, a flat surface may be less affected by surface damage than the profiled surface.

Figure 11A:
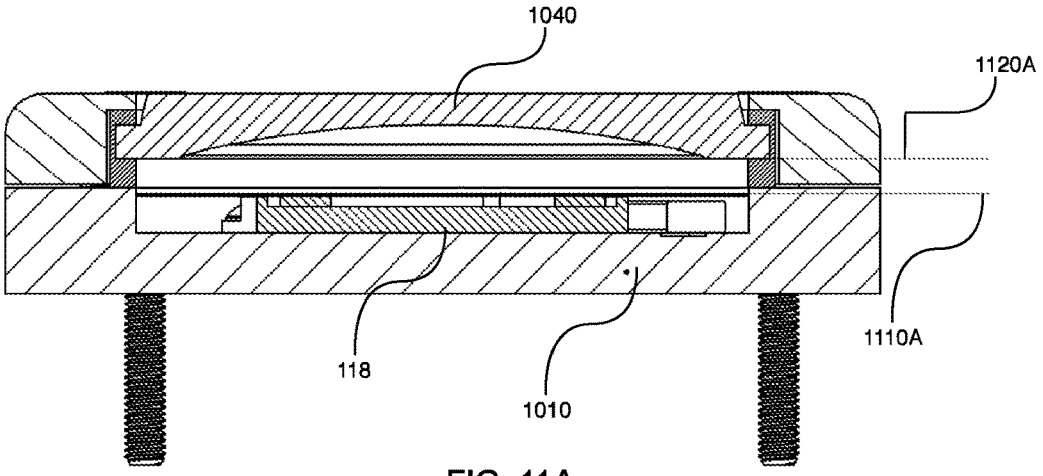
FIGS. 11A through 11C are side cross-sectional views of various example configurations of submersible marine lighting apparatus.
Figure 11B:
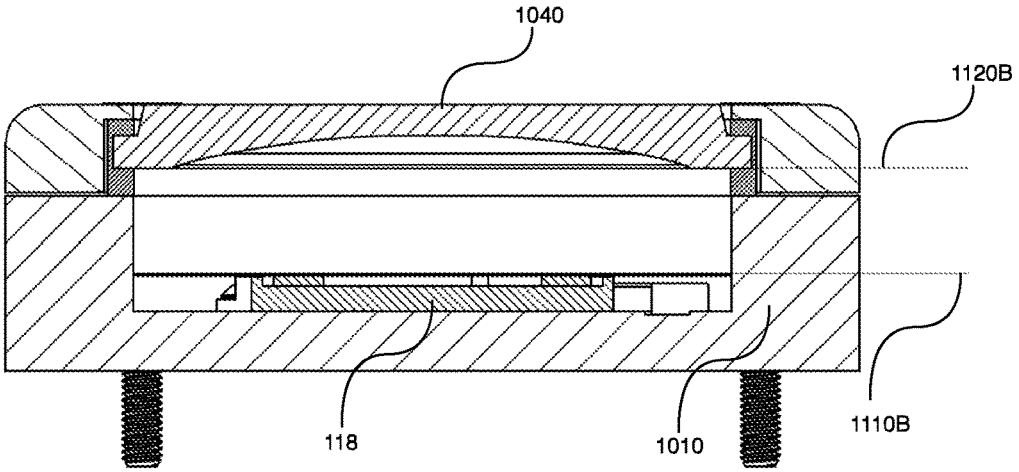
Figure 11C:
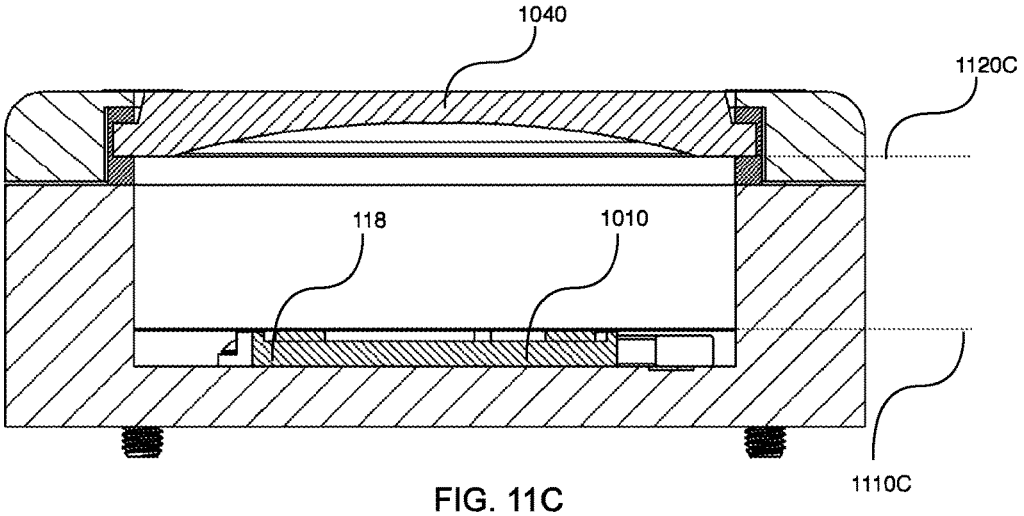

FIGS. 11A through 11C illustrate cross-sectional views of three embodiments of a marine lighting apparatus. For the sake of consistency, the various cross-sectional views may be understood as being three distinct embodiments of the apparatus 1000 of FIG. 10.

In FIG. 11A, a first cross sectional view is illustrated. The apparatus includes an LED array 118 corresponding to the LED array of FIG. 1B. The apparatus also includes a base 1010 and a lens 1040. It is appreciated that, as illustrated, lens 1040 is configured such that the non-profiled surface is exposed to the external environment as discussed previously.

Within FIG. 11A, two demarcation lines are also included and labeled 1110A and 1120A. It is appreciated that these demarcation lines are not physical components of the apparatus but are used to demarcate the location of the top 110A of LED array 118 and the bottom 1120A of lens 1040. It is also appreciated that because these two demarcation points are not at the same location, there is a distance between them. This distance corresponds to the offset distance discussed previously such as in conjunction with FIGS. 1A and 1B.

In the embodiment of FIG. 11A, the distance between top 1110A and bottom 1120A is between 2 mm and 10 mm. As has been previously described, this distance will result in a generally wider transmission angle than will occur in the apparati discussed in conjunction with FIGS. 11B and 11C. Accordingly, FIG. 11A will produce a lower candela value than the other two configurations at a given lumen output.

Moving now to FIG. 11B, the distance between top 1110B and bottom 1120B is greater than between top 1110A and bottom 1120A. For example, in this embodiment, the distance may be between 8 mm and 20 mm. As has been previously described, this distance will result in a generally wider transmission angle than will occur in the apparatus discussed in conjunction with FIG. 11C but in a narrower transmission angle than that of FIG. 11A. Accordingly, FIG. 11B will produce a higher candela value than in FIG. 11A but a lower candela value than in FIG. 11 C at a given lumen output.

Moving now to FIG. 11C, the distance between top 1110C and bottom 1120C is greater than between top 1110A and bottom 1120A and between top 1110B and bottom 1120B. For example, in this embodiment, the distance may be between 15 mm and 30 mm. As has been previously described, this distance will result in a generally narrower transmission angle than that of FIGS. 11A and 11B at a given lumen output.

In Table 1 shown below, various calculations for the embodiments of FIGS. 11A through 11C are shown at particular exemplary values. It is appreciated, however, that the values chosen for Table 1 are illustrative only and other values consistent with this disclosure may be utilized with correspondingly different calculated outputs. With that said, particularly with respect to the chosen "Offset Value," preferred values have been identified.

TABLE 1

| Lumen Output | Recess Diameter | Offset Distance | Candela Output |
|---|---|---|---|
| 1000 | 50 mm | 2 mm | 173 |
| 1000 | 75 mm | 10 mm | 214 |
| 1000 | 50 mm | 8 mm | 228 |
| 1000 | 75 mm | 20 mm | 292 |
| 1000 | 75 mm | 15 mm | 253 |
| 1000 | 150 mm | 30 mm | 253 |

As can be appreciated by the calculations of Table 1, various configurations of offset diameters (e.g., distances between the top of an LED array and the bottom of a lens surface) can be combined with different recess diameters to affect the candela output of an LED array. Notably, a smaller housing with a greater offset distance may produce higher candela output compared to a larger housing with less offset distance. In other configurations, such as comparing the second and third rows of TABLE 1, it is appreciated that a configuration with both narrower recess diameter and a shorter offset distance can produce similar (and even higher) candela output compared to a configuration with a wider recess diameter and longer offset distance (i.e., 214 candelas versus 228 candelas.)

Figure 12:
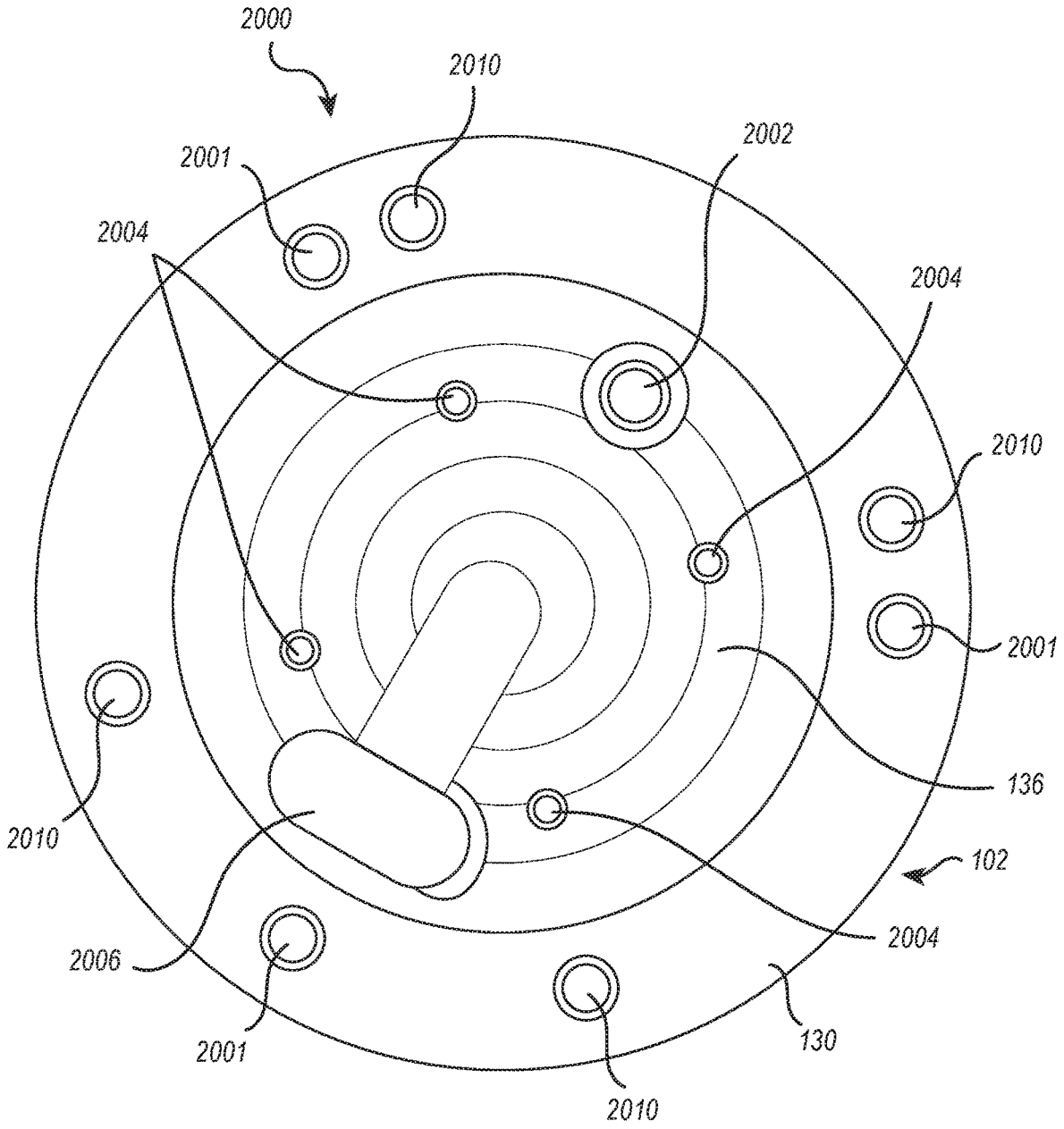
FIG. 12 is a top plan view of an example base of a submersible marine lighting apparatus.
Figure 13:
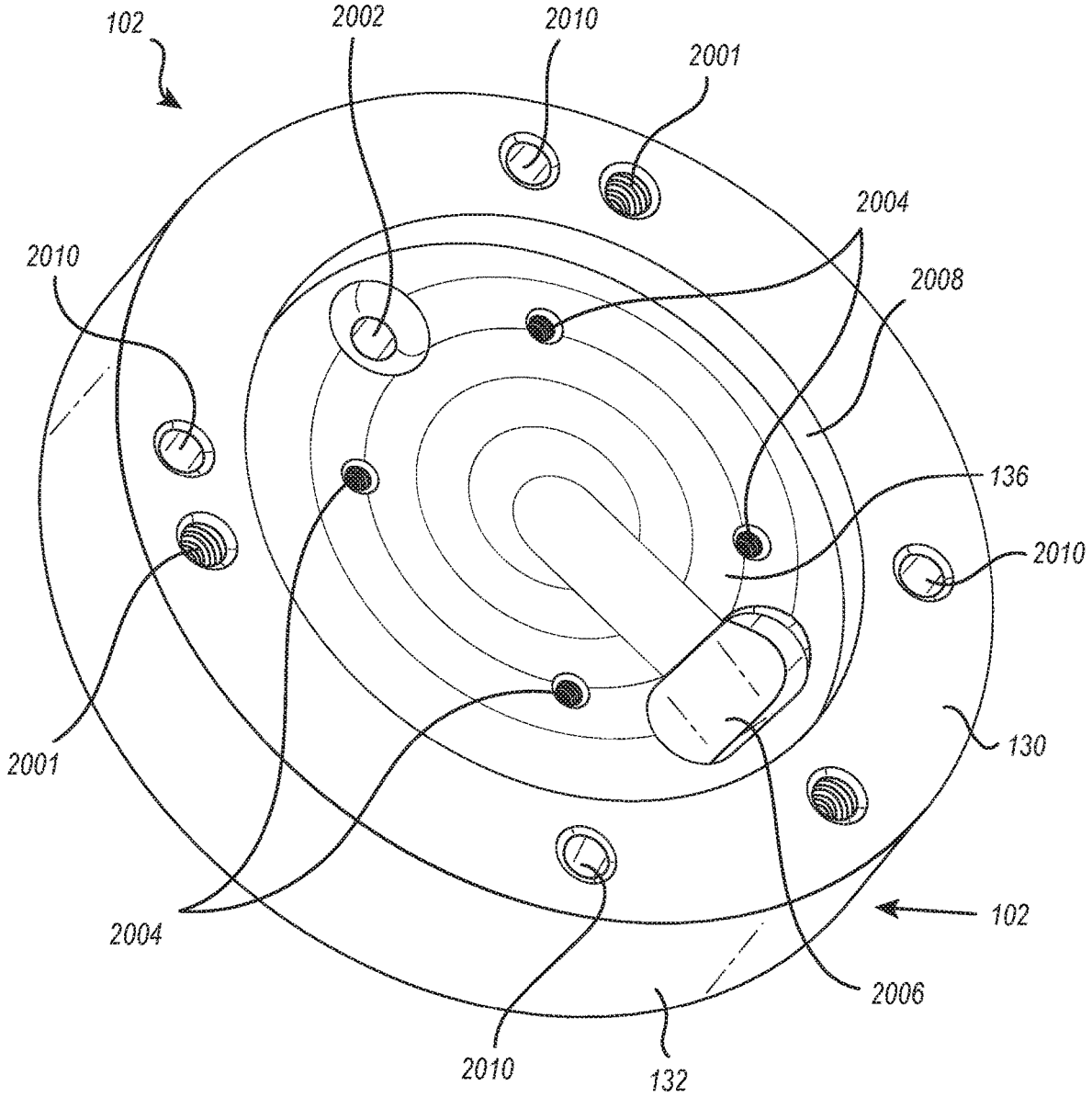
FIG. 13 is a top perspective view of the base of FIG. 12.

FIGS. 12-30 further elucidate features of submersible marine lights illustrated in FIGS. 1-7. Base 102, as shown in FIGS. 12, 13 and 15, comprises a first outer ring body 2003 comprising a top surface 130 having a plurality of external fastener bores 2001 and internal fastener bores 2010. And inner ring pattern 2005 surrounded by outer ring 2003 can comprise a pattern on recessed base surface 136 of a central portion 2007 of base 102. Inner ring pattern 2005 may assist in centering an LED array, or other lighting apparatus, to be fixed within recessed base surface 136 of base 102.

Recessed base surface 136 may include a specialized recess 2006 for receiving thermal switch 106. The recessed base area can also include at least one or more light source attachment points 2004, configured to receive fasteners for securing a lighting apparatus. Light source attachment points 2004 may have an angled or recessed edge 2009*c* to allow the fasteners inserted therein to be positioned flush with recessed base surface 136. Recessed base surface 136 can also include an opening 2002 for a power source (e.g., wires) to be connected to the lighting apparatus. Opening 2002 can include an angled or recessed edge 2011 to accommodate placement of a sealant material around the power source to provide a waterproof seal.

External fastener bores 2001 may be spaced along the outer ring 2003 in order to align with external retention bores 2058 on a retaining cover 2016 (FIGS. 17-18) and/or on a retaining ring 114.

Figure 14:
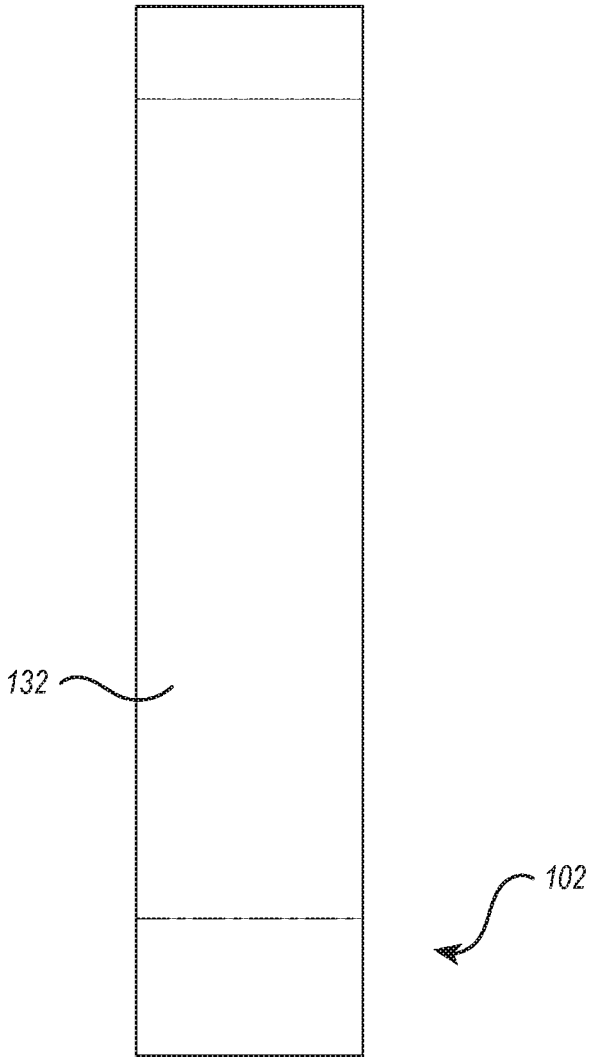
FIG. 14 is a side view of the base of FIG. 12.
Figure 15:
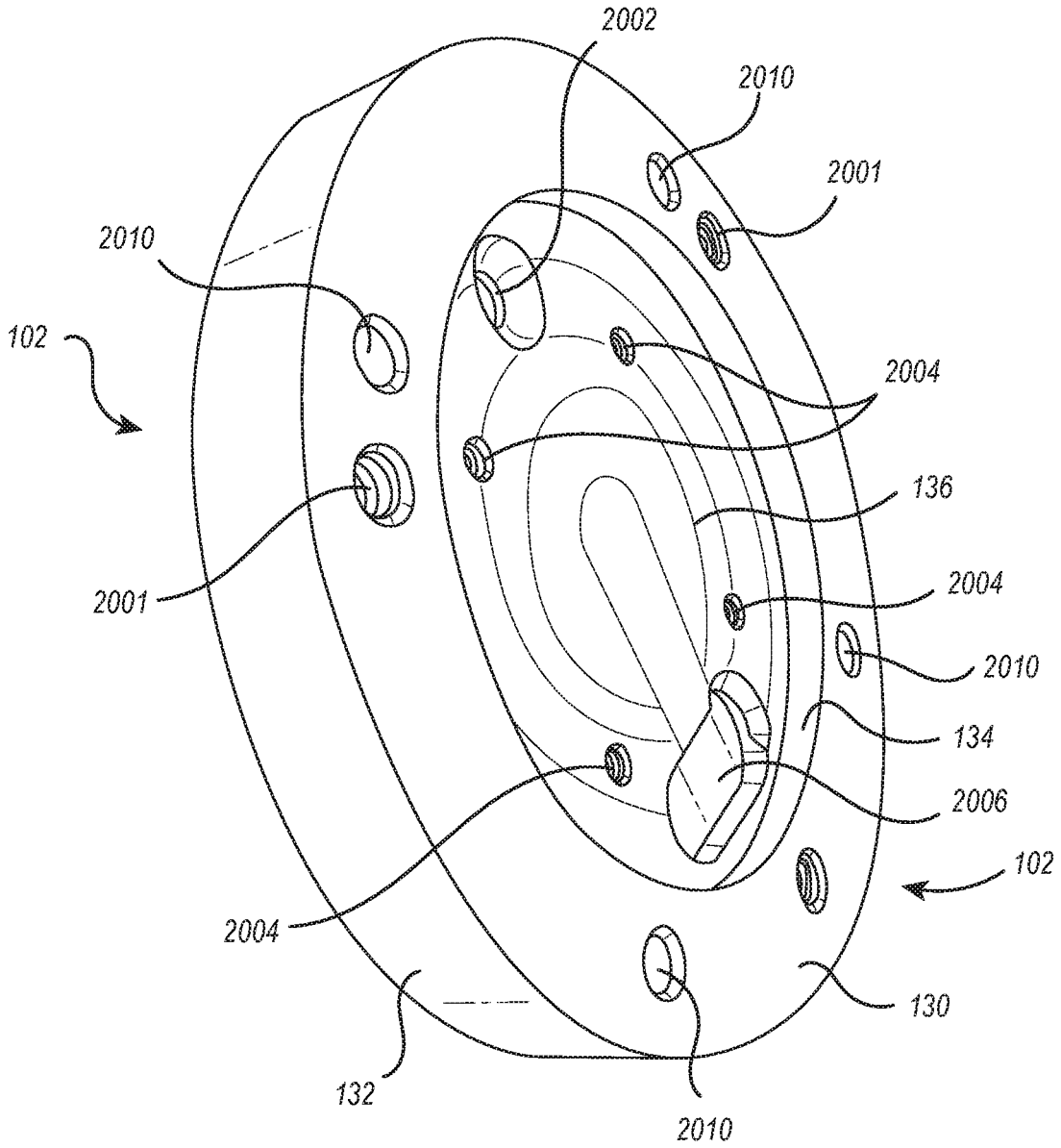
FIG. 15 is a side perspective view of the base of FIG. 12.

FIG. 14 is a side view of base 102. Base 102 can have wide or thick sidewalls 2013. Direction S may have a width of at least about 0.15" to 2.0", 0.25" to 1.50", of at least about 0.5" to 1.25", of at least about 0.75" to 1.0". It may be advantageous for base 102 to have thick sidewalls 2013 to allow base 102 to serve as a heat sink and disperse heat generated by the lighting apparatus out and away from submersible marine light 100.

Figure 16:
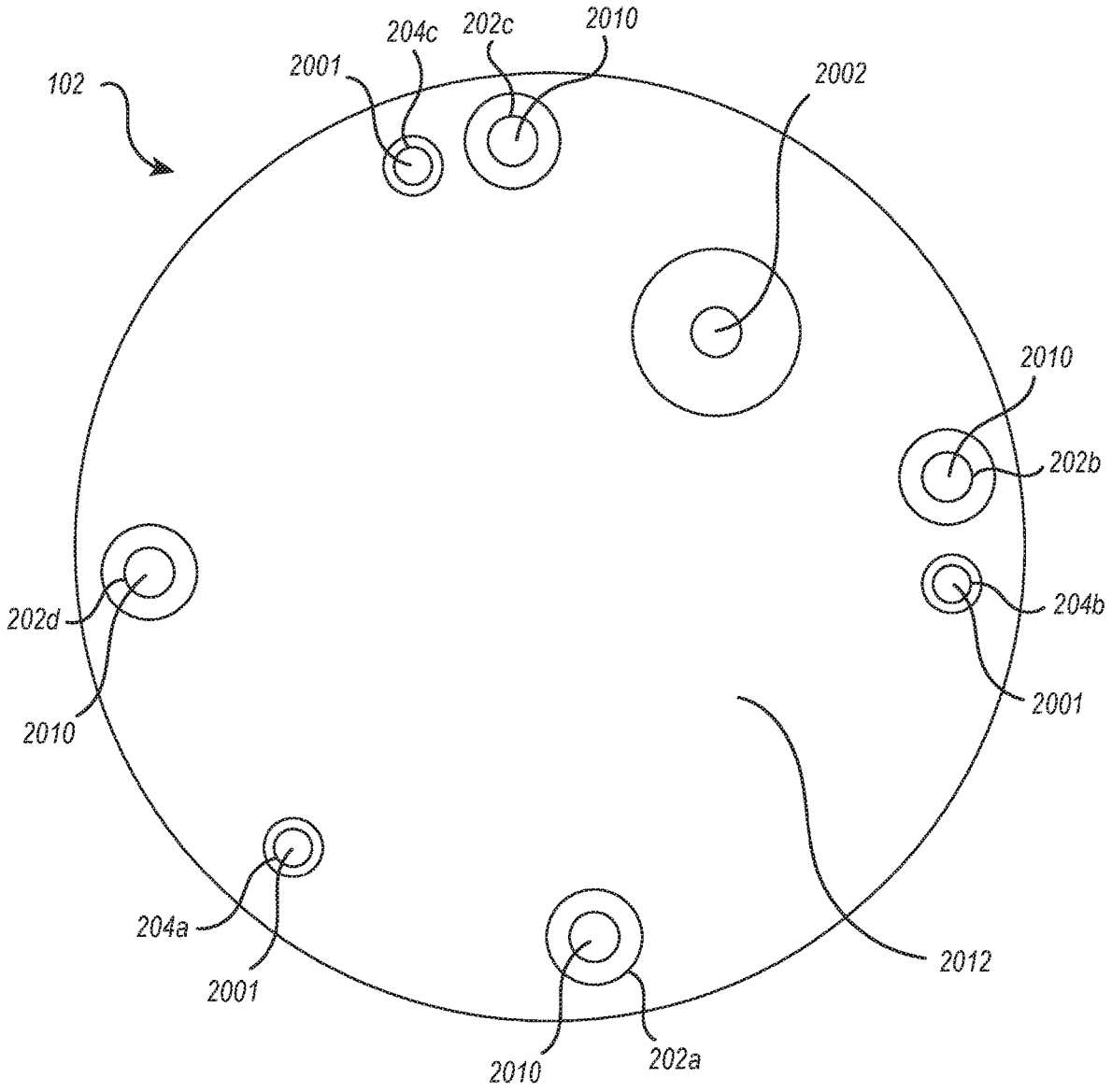
FIG. 16 is a bottom plan view of the base of FIG. 12.

Turning now to FIG. 16, the base bottom 2012 can have a plurality of external fastener bores 2001 and a plurality of internal fastener bores 2010. Internal fastener bores 2010 may be recessed 2015 to allow a fastener inserted therein to be positioned flush with the surface of base bottom 2012 to maintain a flat or level plane across the surface of base bottom 2012. Opening 2002 for a power source can also be visible on base bottom 2012.

Figure 17:
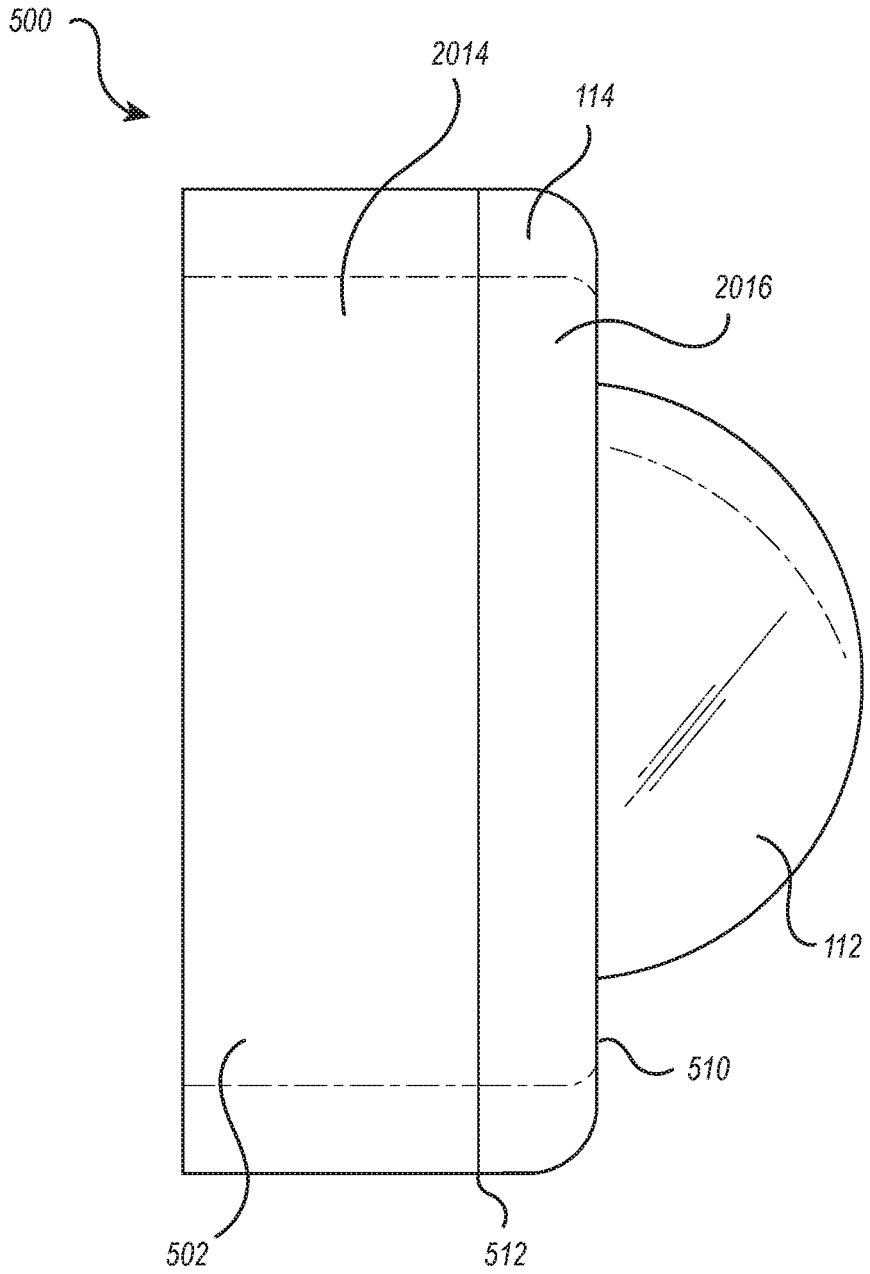
FIG. 17 is an elevation view of an example assembled submersible marine lighting apparatus substantially similar to the submersible marine lighting apparatus of FIGS. 1-6.
Figure 21:
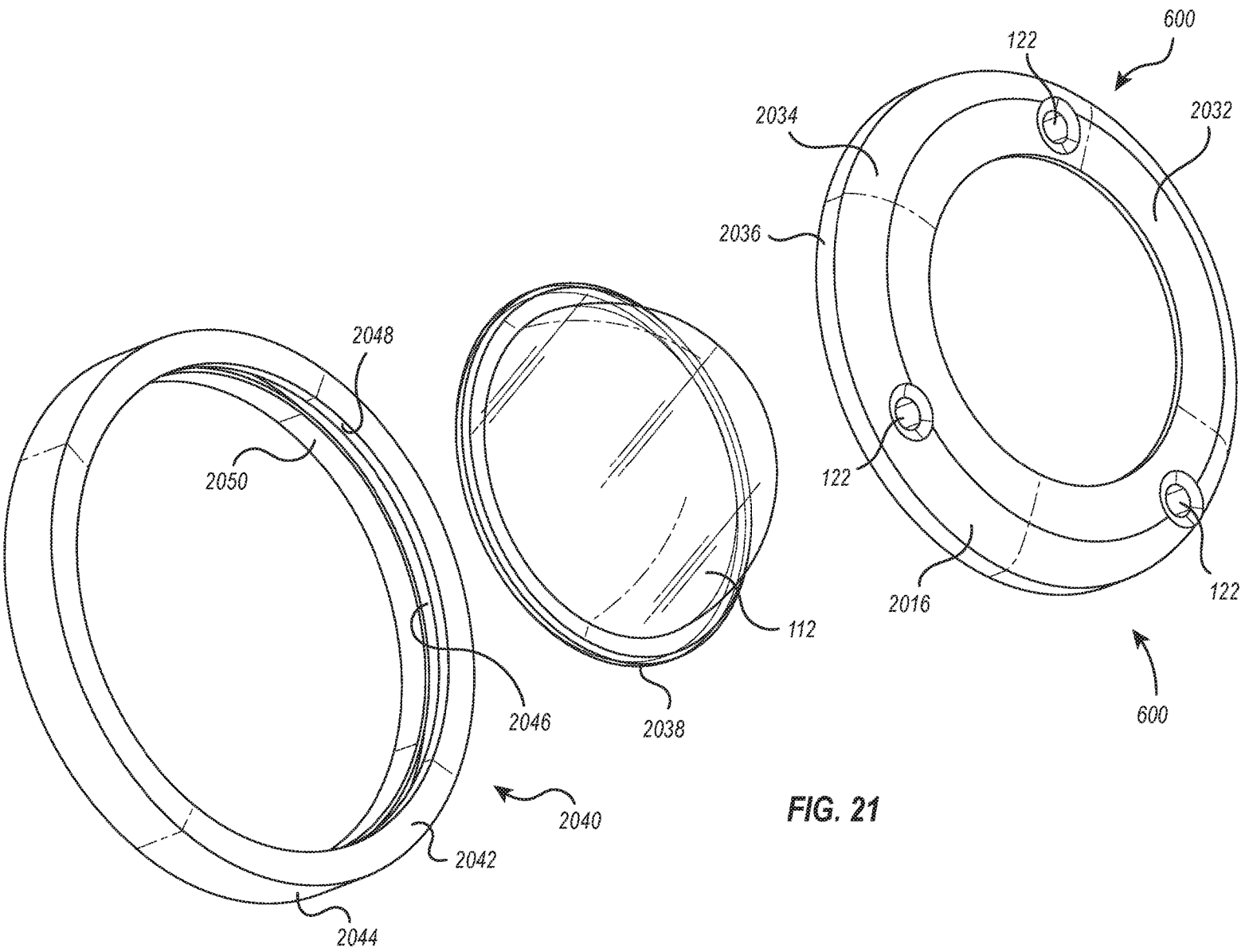
FIG. 21 is an exploded top perspective view of a retaining ring, plano-convex lens, and lens gasket of a submersible marine lighting apparatus substantially similar to analogous components illustrated in FIGS. 1A and 1B.
Figure 22:
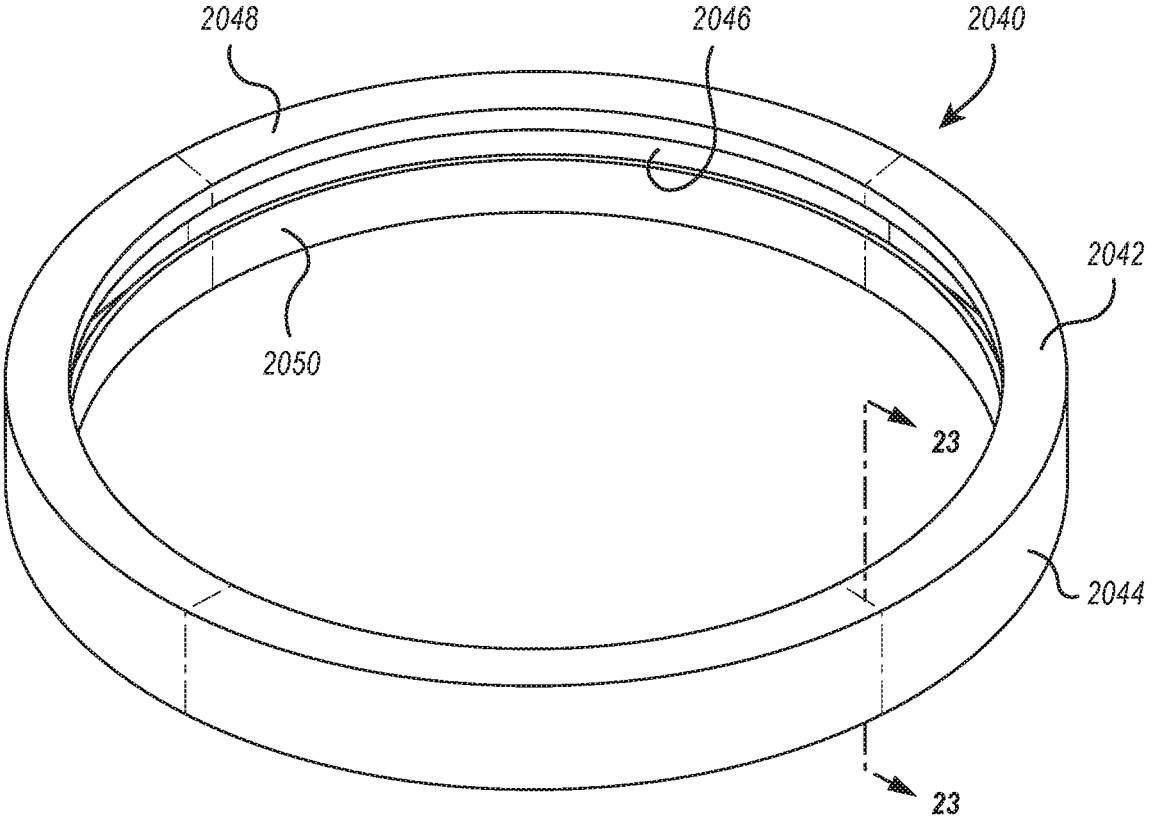
FIG. 22 is a top perspective view of a lens gasket substantially similar to the lens gasket of the submersible marine lighting apparatus of FIGS. 1-6.
Figure 23:
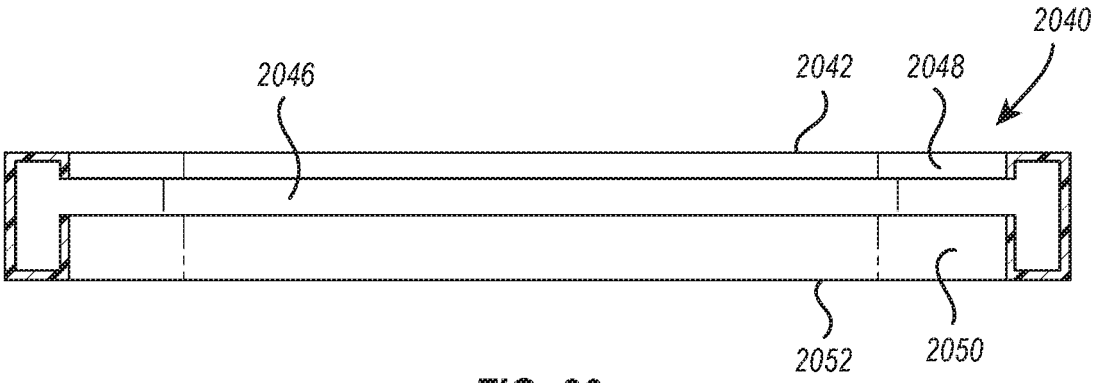
FIG. 23 is a side cross-sectional view of the lens gasket of FIG. 22.
Figure 24:
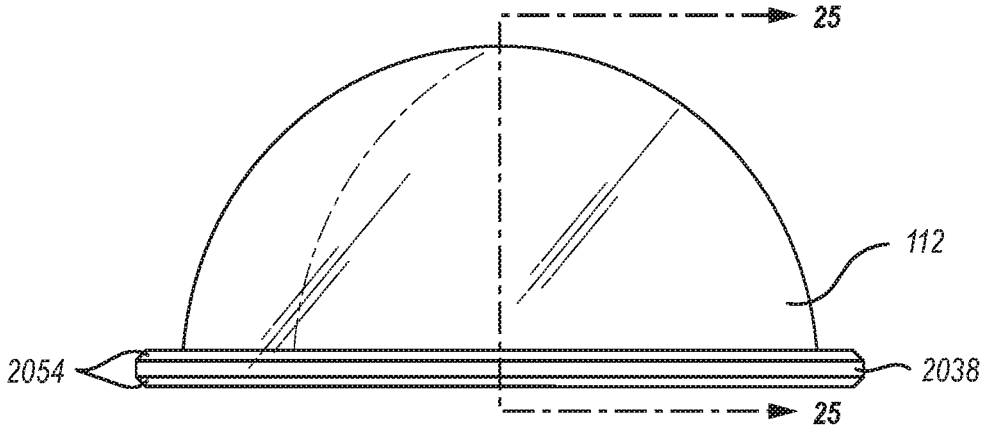
FIG. 24 is an elevation view of a plano-convex lens substantially similar to the plano-convex lens of the submersible marine lighting apparatus of FIGS. 1-6.
Figure 25:
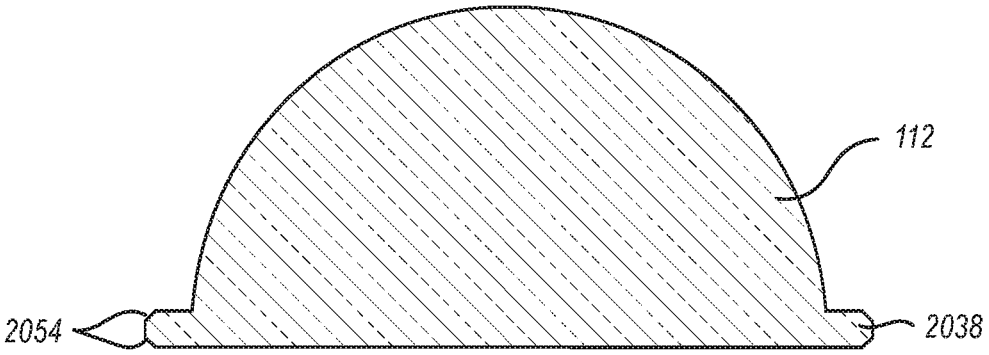
FIG. 25 is a side cross-sectional view of the plano-convex lens of FIG. 24.

FIG. 17 illustrates a side view of an assembled submersible marine light 100. In some embodiments, base 102 may be selectively attached to a retaining ring 114. Retaining ring 114 can be configured to allow a lens 112 to protrude outward from base 102 while simultaneously securing lens 112 within base 102 by circumscribing and covering a flange 2038 of the lens 112 (FIG. 21). In some embodiments, base 102 and retaining ring 114 may be seated within a base cover 2014 and secured with a retaining cover 2016, while in other embodiments, a base cover 2014 and retaining cover 2016 may not be used.

Figure 18:
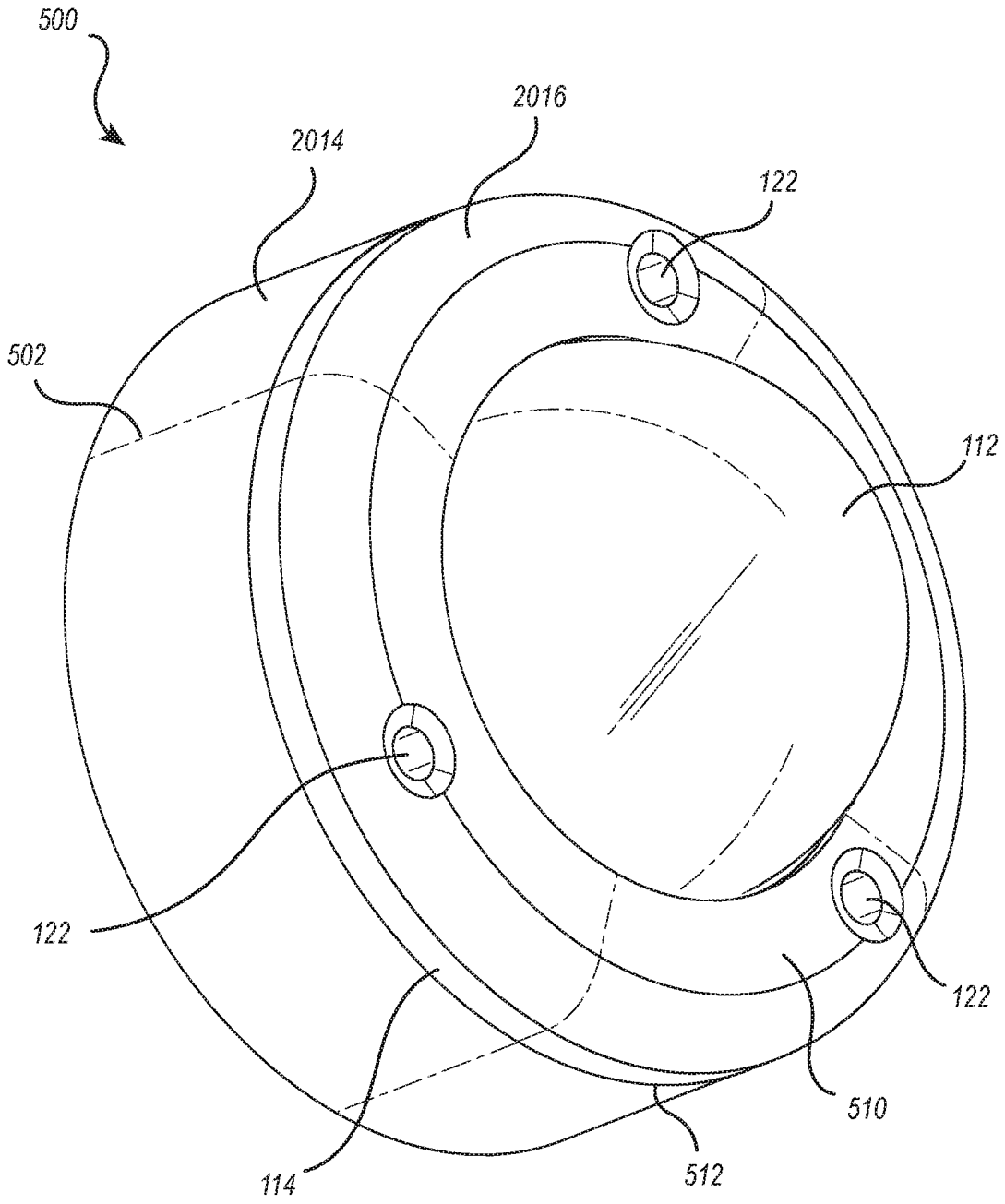
FIG. 18 is a top perspective view of the assembled submersible marine lighting apparatus of FIG. 17.

Retaining ring 114 of submersible marine light 100, as shown in FIG. 18, can have a chamfer 510 angled inwards and downwards towards base 102. Chamfer 510 may aid in securing flange 2038 of lens 112 within base 102, and it may help to form a water-tight seal against lens gasket 2040 contained therein. Retaining ring 114 can also include one or more external retention bores 2058 for receiving cap screws 122*a-c* for attaching submersible marine light 100 to the side of a marine vessel.

Figure 19:
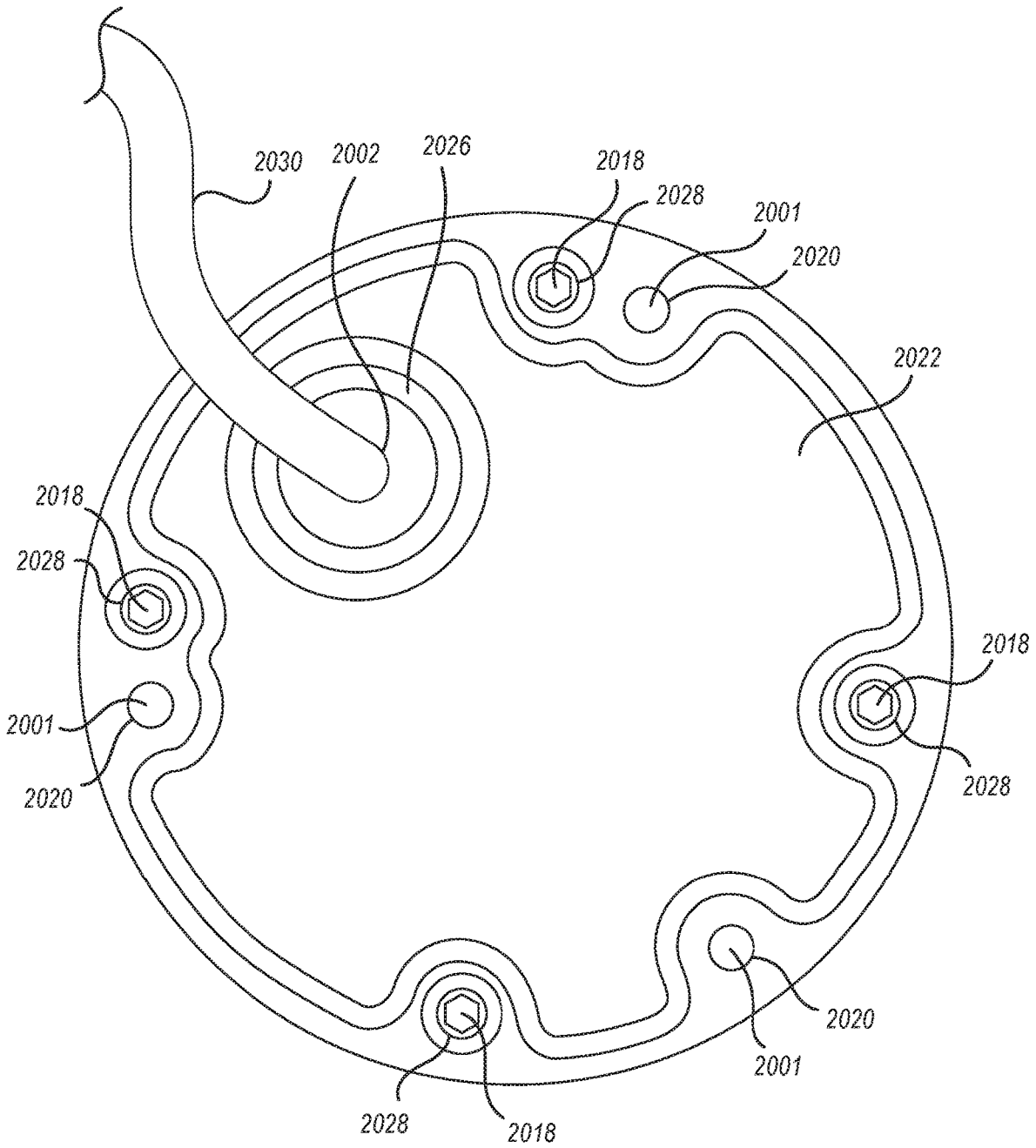
FIG. 19 is a bottom plan view of the assembled submersible marine lighting apparatus of FIG. 17.
Figure 20:
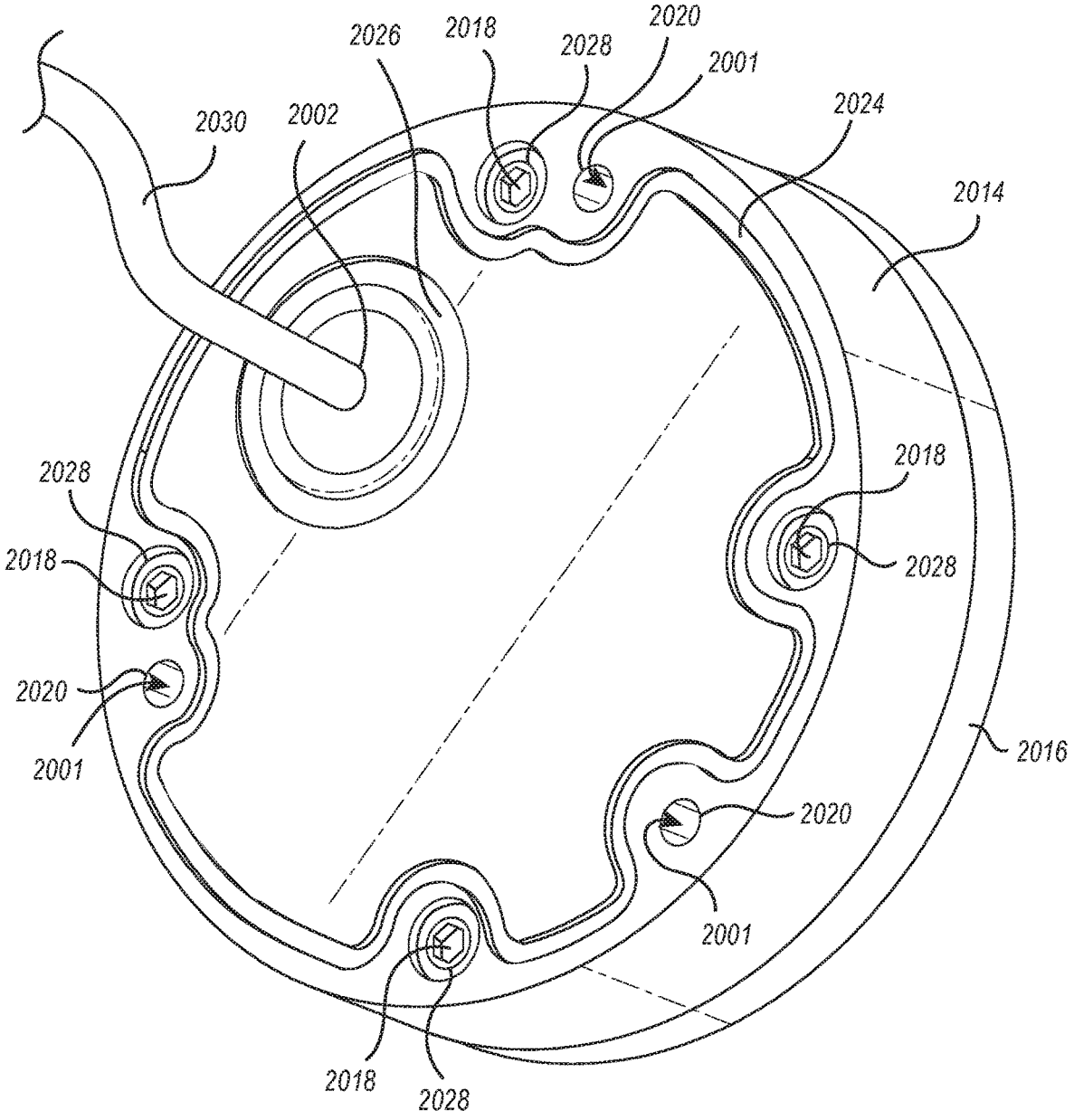
FIG. 20 is a bottom perspective view of the assembled submersible marine lighting apparatus of FIG. 17.

The bottom surface 2022 of a base cover 2014, as illustrated in FIG. 19, can have one or more cover bores 2020 which are spaced to align with external fastener bores 2001 on base 102 and external retention bores 2058 on retaining ring 114. Fasteners inserted into a top 2064 of retaining ring 114 can be inserted through external fastener bores 2001 to exit through cover bores 2020 to attach the submersible marine light 100 to a surface such as the surface of a marine vessel (e.g., using nuts and washers for attachment to the threaded ends of screws 122*a-c* or wood screws that screw directly into fiberglass or other boat structure). Although bores 2001 are illustrated in FIGS. 13 and 15 as being threaded, cap screws 112*a-c* do not typically engage the threads but are of smaller diameter. Rather, the threads be used to remove a light from a side of a watercraft, such as by first removing cap screws 112*a-c* and inserting machine screws or other threaded devices in order to apply force to break the adhesive bond between the light and watercraft.

Bottom surface 2022 of base cover 2014 can also have a plurality of cover bores 2018 configured to align with internal fastener bores 2010 on base 102 and tapped threaded internal retention apertures 2060 opening through a bottom surface of retaining ring 114. A plurality of fasteners, such as button head cap screws 116*a-d*, can be inserted through bottom surface 2022 of base cover 2014 and extend through base 102 and into threaded internal retention bores 2060 through bottom surface 2056 of retaining ring 114 and/or retaining cover 2016. Bottom surface 2022 of base cover 2014 can also include an opening 2002 for a power source 2030. Bottom surface 2022 can also include an indentation or groove 2024 forming a closed loop and situated on inner side 2066 of cover bores 2018, 2020. Groove 2024 may help to form a seal around power source 2030 and keep debris from interfering with power source 2030.

FIG. 21 illustrates a lens assembly 2068 of submersible marine light 100. The lens assembly can comprise a retaining ring 114 and/or retaining cover 2016, a lens 112, and a lens gasket 2040. Retaining ring 114 can include varying edge angles. For example, retaining ring 114 may include an angled top edge 2032, with edge 2032 being angled downward and inward towards the center of light 100, a chamfered edge 2034, and a straight edge 2036, chamfered edge 2034 being situated between and connecting angled top edge 2032 and straight edge 2036. The shape of retaining ring 114 can be shaped to press lens gasket 2040 against flange 2038 of lens 112 to create a water-tight seal to keep water from entering the interior of light 100.

The lens gasket 2040 can have a top surface 2042 and a side surface 2044, culminating in a top sealing edge or flange 2048. Lens gasket 2040 can also have a bottom surface 2052 and a bottom sealing edge 2050. An annular groove or recess 2046 can be situated between top sealing edge 2048 and bottom sealing edge 2050. Annular groove or recess 2046 can receive flange 2038 of lens 112 and form a seal around chamfered edges 2054 of flange 2038. Lens gasket 2040 may be formed of a flexible polymer, such as elastomeric polymers, for example, silicone.

Figure 26:
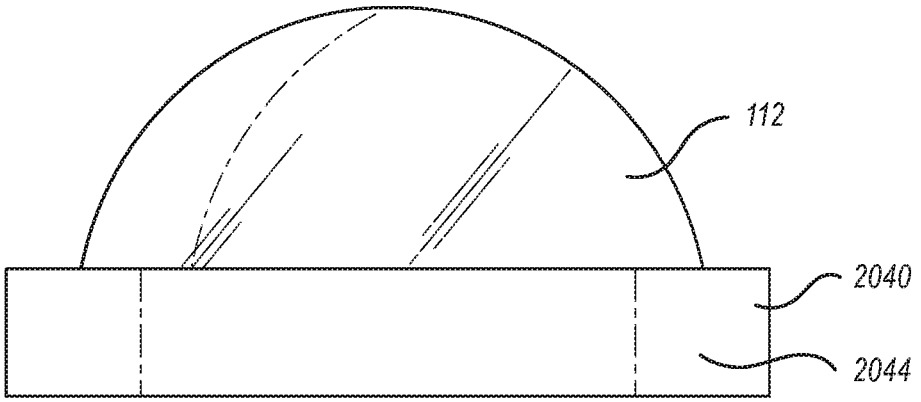
FIG. 26 is an elevation view of the lens gasket of FIG. 22 attached around the circumscribing flange of the plano-convex lens of FIG. 24.
Figure 27:
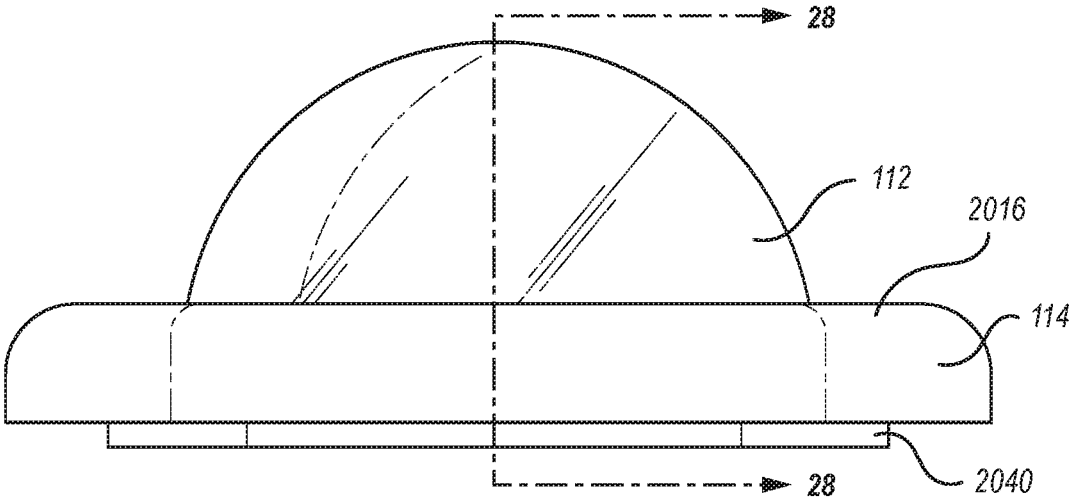
FIG. 27 is an elevation view of a lens assembly of a submersible marine lighting apparatus incorporating a retaining ring, plano-convex lens, and lens gasket.
Figure 28:
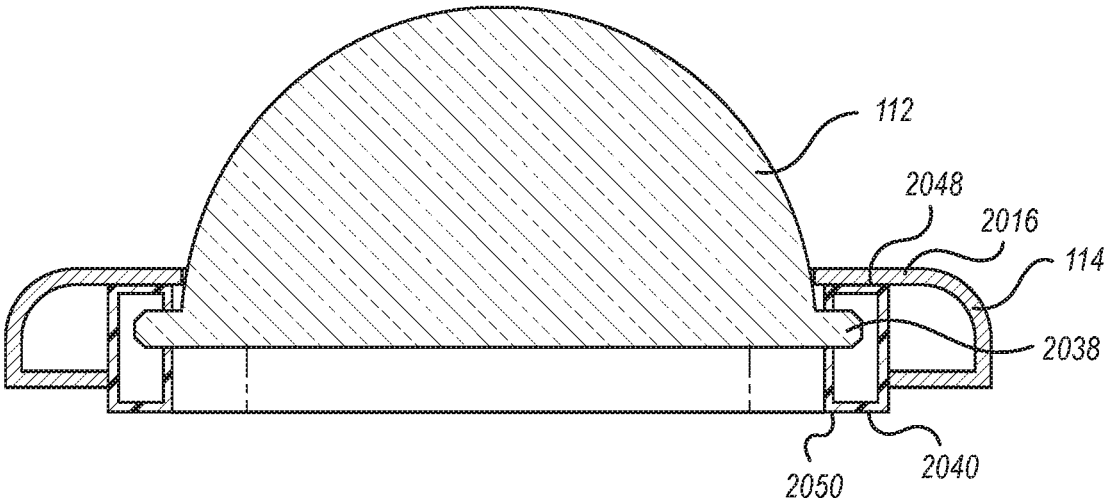
FIG. 28 is a side cross-sectional view of the lens assembly of FIG. 27.

As illustrated in FIGS. 26-28, lens gasket 2040 may be placed over and around flange 2038 of lens 112. Retaining ring 114 may be placed over the top of lens 112, allowing lens 112 to protrude outward through top 2064 of retaining ring 114, while securing flange 2038 of lens 112 within retaining ring 114. Bottom surface 2052 of lens gasket 2040 can extend beyond bottom surface 2056 of retaining cover 2016 and retaining ring 114. When lens assembly 2068 is secured to base 102, lens gasket 2040 can be compressed to form a water-tight seal around flange 2038 of lens 112, and around seal 512, seal 512 being the interface between base 102 and retaining ring 114.

Figure 29:
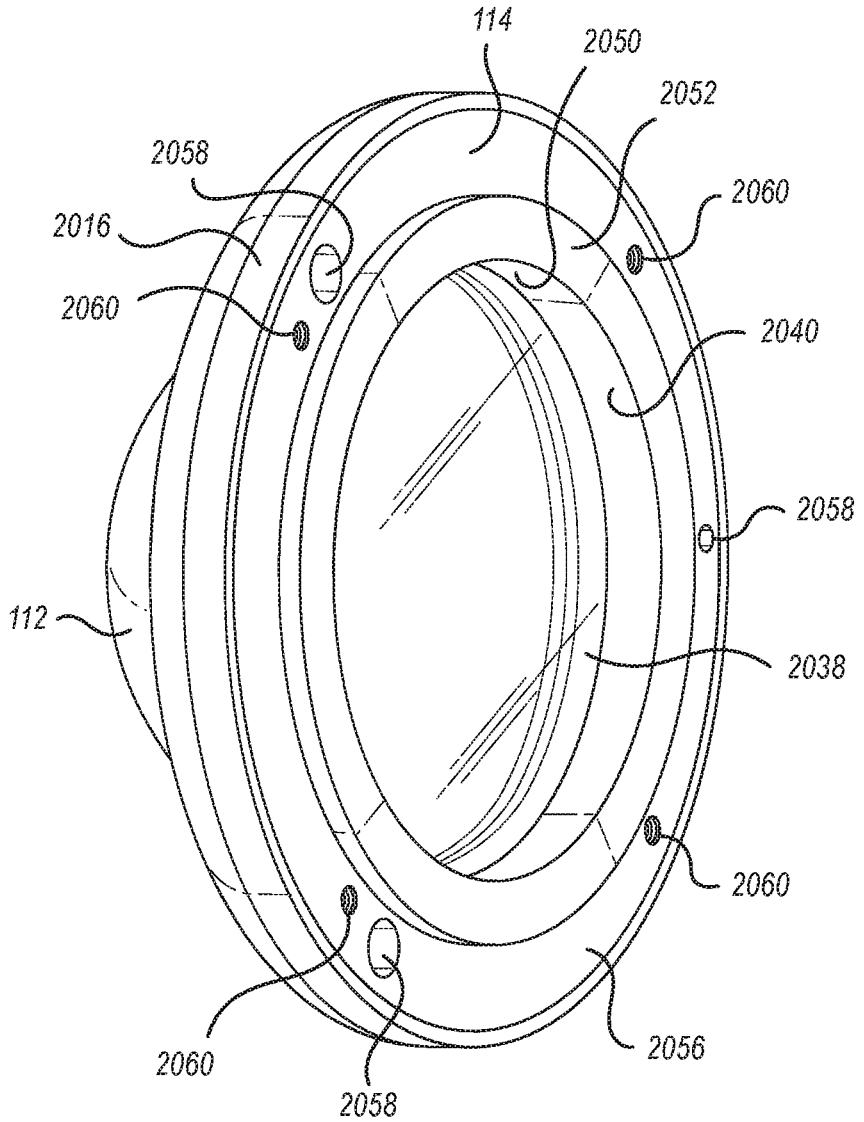
FIG. 29 is a bottom perspective view of the lens assembly of FIG. 27.
Figure 30:
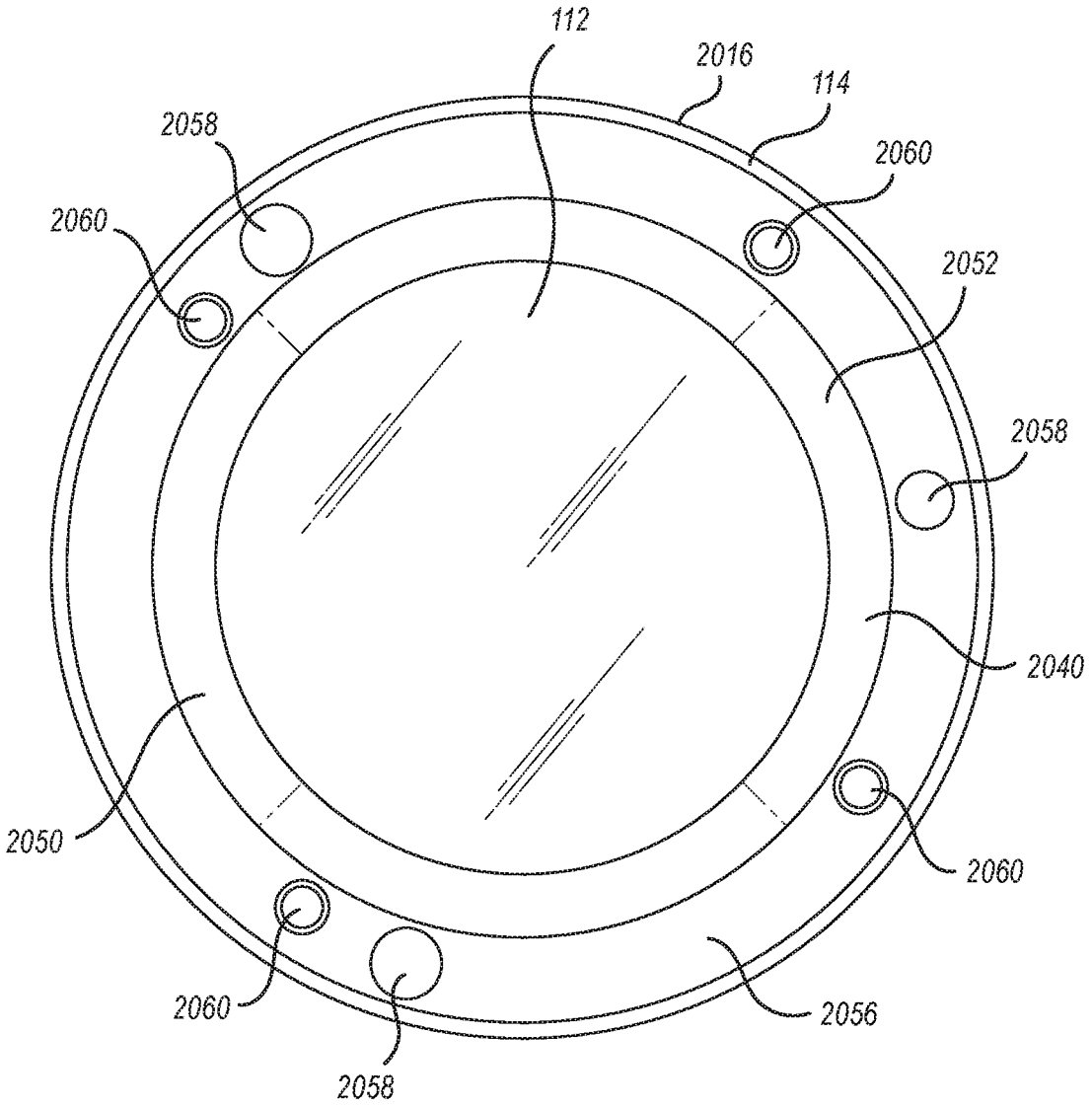
FIG. 30 is a bottom plan view of the lens assembly of FIG. 27.

FIGS. 29-30 illustrate a bottom view of a lens assembly 2068. Bottom surface 2056 of retaining ring 114, as shown, includes a plurality of internal retention bores 2060 which terminate within retaining ring 114 and do not open to top 2064 of retaining ring 114.

Figure 31A:
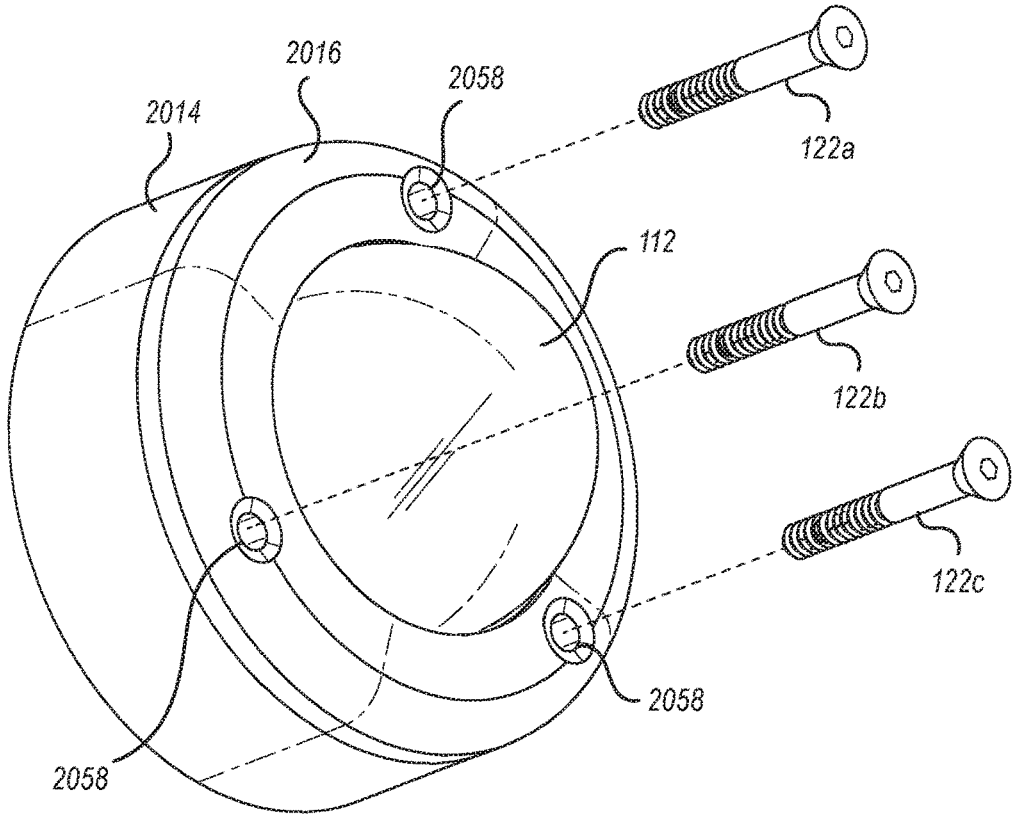
FIG. 31A is a top perspective view if a partially assembled configuration of a submersible marine lighting apparatus substantially the submersible marine lighting apparatus of FIGS. 1-6.
Figure 31B:
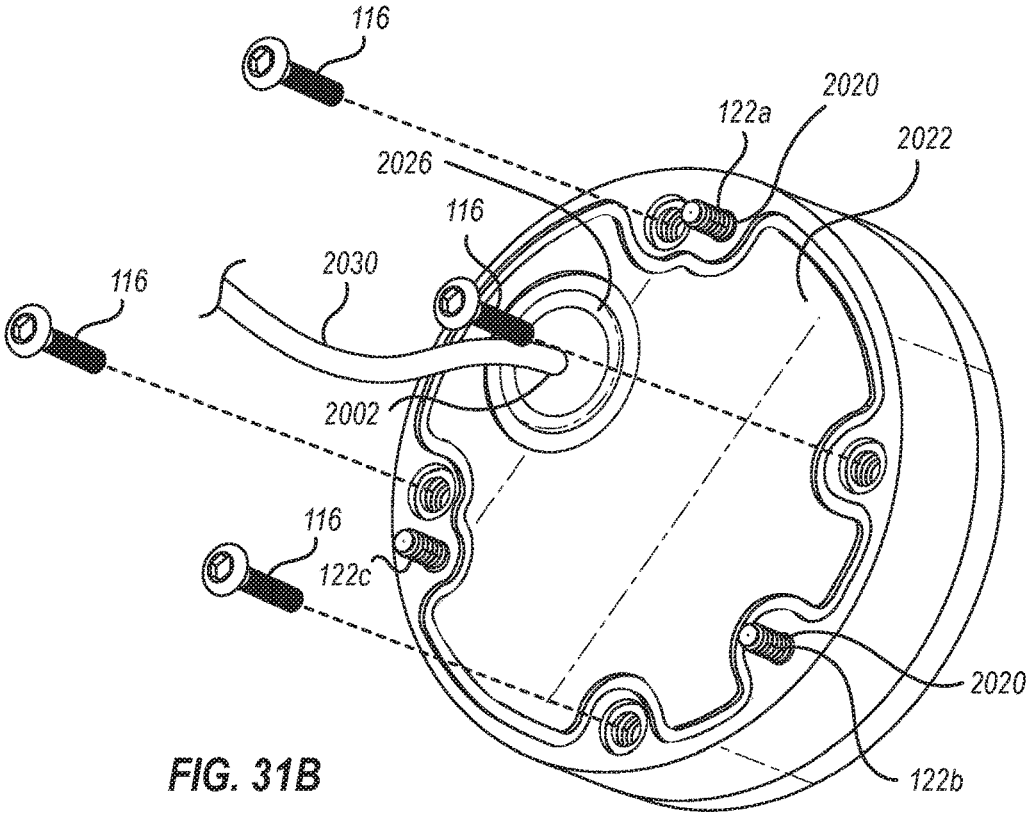
FIG. 31B is a bottom perspective view if another partially assembled configuration of the submersible marine lighting apparatus of FIG. 31A.

FIGS. 31A-31B illustrate an embodiment of a mode of assembling submersible marine light 100. Screws 116 can be inserted into and through bottom 2022 of base 102 into internal fastener bores 2010 which align with retention bores 2060 in bottom surface 2056 of retaining ring 114. When screws 116 are inserted and secured within the bores, this can compress the lens gasket 2040 contained therein to cause lens gasket 2040 to form a watertight seal to keep water and/or debris from entering the inside of submersible marine light 100.

Figure 32:
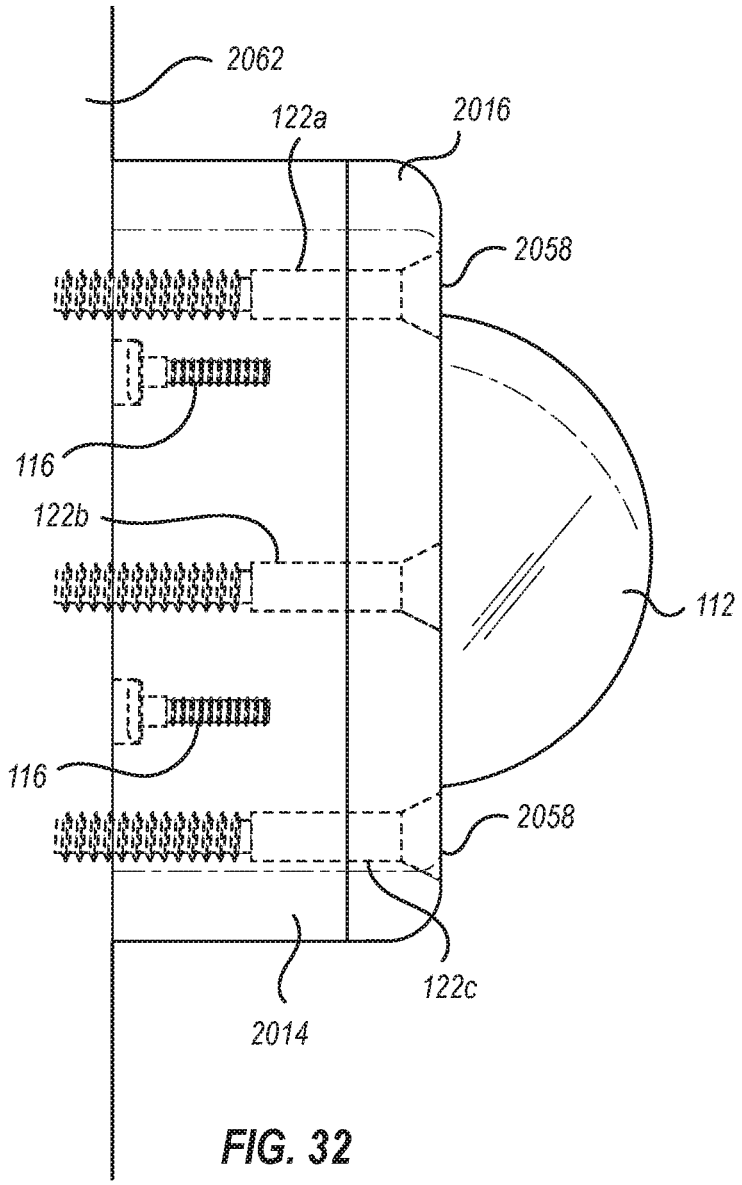
FIG. 32 is an elevation view of an assembled configuration of the submersible marine lighting apparatus of FIGS. 31A and 31B attached to a watercraft.

Once screws 116 seal base 102 to retaining ring 114, submersible marine light 100 may be fixed to a marine vessel, such as a surface of a boat 2062. A plurality of screws 122*a-c* can be inserted through external retention bores 2058 on top 2064 of retaining ring 114. Retention bores 2058 can align with external fastener bores 2001 in base 102. Screws 122*a-c* can extend through retaining ring 114 and through base 102 to attach into the surface of boat 2062 as shown in FIG. 32.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A submersible light for mounting to a hull of a watercraft, comprising:

a unitary cylindrical base made from thermally conductive metal and having an outer wall, a top surface, a bottom surface, an interior recess, and a recess base surface, wherein the bottom surface is substantially flat so that the unitary cylindrical base abuts but does not pass through the hull of a watercraft when the submersible light is mounted thereon;

a light-emitting diode (LED) array positioned within the interior recess and mounted on the recess base surface so as to be thermally coupled to the unitary cylindrical base;

an optical lens having a first surface oriented to receive light from the LED array, a light emitting surface opposite the first surface, and a circumscribing flange;

a lens gasket having an outer wall disposed around an outer surface of the circumscribing flange of the optical lens and an interior groove or recess in the outer wall for receiving and cooperating with the circumscribing flange of the optical lens to maintain an offset distance between the first surface of the optical lens and the LED array; and a cylindrical retaining ring secured to the unitary cylindrical base and retaining the circumscribing flange of the optical lens and the lens gasket between the base and the retaining ring, wherein the cylindrical retaining ring and unitary cylindrical base together form an uninterrupted cylindrical outer wall extending around an entire circumference of the base, wherein the retaining ring has a top surface circumscribing the light-emitting surface of the optical lens and a bottom surface oriented toward the unitary cylindrical base, and wherein the retaining ring is spaced apart from the bottom surface of the unitary cylindrical base so that when the submersible light is mounted to the hull of a watercraft the retaining ring does not contact the hull.

2. The submersible light of claim 1, wherein the optical lens is a plano-convex lens made of glass and has a planar inner surface oriented toward the LED array and a convex light emitting outer surface.

3. The submersible light of claim 1, wherein the lens gasket cooperates with the circumscribing flange to maintain the offset distance between 2 mm and 25 mm.

4. The submersible light of claim 1, wherein the cylindrical retaining ring is made from thermally conductive metal.

5. The submersible light of claim 1, wherein the LED array is a chip on board (COB) LED array.

6. The submersible light of claim 1, wherein the optical lens is a Fresnel lens.

7. The submersible light of claim 1, wherein the interior recess has a height that is between 5 mm and 25 mm greater than a total assembled height of the LED array.

8. The submersible light of claim 1, wherein the cylindrical base includes a plurality of apertures therethrough that receive a plurality of screws that secure the retaining ring to the cylindrical base.

9. The submersible light of claim 8, wherein the plurality of screws include head ends adjacent to the bottom surface of the cylindrical base and threaded ends that engage corresponding threaded apertures in the retaining ring that open through a first surface of the retaining ring adjacent to the top surface of the cylindrical base but do not pass through a second surface of the retaining ring opposite the first surface.

10. The submersible light of claim 9, wherein the apertures in the cylindrical base are countersunk so that heads of the plurality of screws do not protrude beyond the bottom cylindrical of the circular base.

11. The submersible light of claim 1, further comprising a plurality of apertures passing through the retaining ring and the cylindrical base for receiving therethrough a plurality of screws for securing the submersible light to the hull of a watercraft, wherein the apertures through the retaining ring are configured so that heads of the screws make abutment with the retaining ring.

12. The submersible light of claim 1, further comprising a control system for controlling light output of the LED array, the control system comprising:

an external fan box electrically connected between a power system of a watercraft and to the LED array, wherein the external fan box comprises:

a master switch;

a voltage up-converter configured to receive a voltage corresponding to the voltage of the power system of the water craft and output a higher voltage corresponding to a voltage requirement of the LED array; and a wireless transceiver; and a wireless device configured to transmit signals to the wireless transceiver in order to control functionality of the control system.

13. The submersible light of claim 12, wherein the voltage up-converter receives power from the power system of the watercraft and outputs at least 36-volt nominal power.

14. The submersible light of claim 12, wherein the wireless device is a wireless fob.

15. The submersible light of claim 12, wherein the wireless device is a touch pad, smart phone, tablet computer, or hand-held remote.

16. A submersible light for mounting to a hull of a watercraft, comprising:

a unitary cylindrical base made from thermally conductive metal and having an outer wall, a top surface, a bottom surface, an interior recess, and a recess base surface defining a recess;

a light-emitting diode (LED) array positioned within the interior recess and mounted on the recess base surface so as to be thermally coupled to the unitary cylindrical base;

a thermal switch positioned within the interior recess of the unitary cylindrical base and received by the recess defined by the recess base surface of the unitary cylindrical base;

a plano-convex optical lens having a planar surface configured to receive light from the LED array, a convex light emitting surface, and a circumscribing flange, a lens gasket positioned between the unitary cylindrical base and the optical lens; and a retaining ring made from thermally conductive metal, being secured to the unitary cylindrical base, and retaining the circumscribing flange of the optical lens and the lens gasket between the base and the retaining ring, wherein the retaining ring has a top surface circumscribing the light-emitting surface of the optical lens and a bottom surface adjacent to the top surface of the unitary cylindrical base, and wherein the retaining ring has a diameter no greater than a diameter of the unitary cylindrical base so as to not contact the hull of a watercraft when the submersible light is mounted thereon.

17. The submersible light of claim 16, wherein the plano-convex optical lens is made of glass.

18. The submersible light of claim 16, wherein the LED array is mounted on the recess base surface by a plurality of screws inserted into corresponding holes in the recess base surface.

19. A submersible light for mounting to a hull of a watercraft, comprising:

a unitary cylindrical base made from thermally conductive material and having an uninterrupted cylindrical outer wall extending around an entire circumference of the base, a top surface, a bottom surface, an interior recess, and a recess base surface defining a recess, wherein the bottom surface is substantially flat so that the unitary cylindrical base abuts but does not pass through the hull of a watercraft when the submersible light is mounted thereon;

a light-emitting diode (LED) array positioned within the interior recess and mounted on the recess base surface so as to be thermally coupled to the base;

an optical lens having a first surface oriented to receive light from the LED array, a light emitting surface opposite the first surface, and a circumscribing flange;

a lens gasket positioned between the unitary cylindrical base and the optical lens;

a cylindrical retaining ring made from thermally conductive material, having an uninterrupted cylindrical outer wall extending around an entire circumference of the retaining ring, being secured to the unitary cylindrical base, and retaining the circumscribing flange of the optical lens and the lens gasket between the base and the retaining ring;

a plurality of screws securing the retaining ring to the circular base, each screw passing through a corresponding aperture in the circular base and engaging a corresponding aperture in the retaining ring; and a plurality of additional apertures passing through the retaining ring and the circular base for receiving therethrough a plurality of additional screws for securing the submersible light to the hull of a watercraft, wherein the additional apertures through the retaining ring are countersunk so that heads of the additional screws make abutment with the retaining ring without protruding above the retaining ring, wherein the retaining ring has a top surface circumscribing the light-emitting surface of the optical lens and a bottom surface adjacent to the top surface of the unitary cylindrical base, wherein the retaining ring has a diameter no greater than a diameter of the unitary cylindrical base so as to not contact the hull of a watercraft when the submersible light is mounted thereon.

20. The submersible light of claim 19, wherein the plurality of screws include head ends adjacent to the bottom surface of the circular base and threaded ends that engage corresponding threaded apertures in the retaining ring that open through a first surface of the retaining ring adjacent to the top surface of the circular base but do not pass through a second surface of the retaining ring opposite the first surface, and wherein the apertures in the circular base are countersunk so that heads of the plurality of screws do not protrude beyond the bottom surface of the circular base.

* * * * *